US011617698B2

(12) United States Patent
Newkirk et al.

(10) Patent No.: US 11,617,698 B2
(45) Date of Patent: Apr. 4, 2023

(54) USER MODULE FOR A PATIENT SUPPORT APPARATUS

(71) Applicant: Hill-Rom Services, Inc., Batesville, IN (US)

(72) Inventors: David C. Newkirk, Lawrenceburg, IN (US); Carl William Riley, Batesville, IN (US); James L. Walke, Batesville, IN (US); Brian T. Wiggins, Burlington, KY (US); Jack B. Wilker, Shelbyville, IN (US); Robert Mark Zerhusen, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 17/591,019

(22) Filed: Feb. 2, 2022

(65) Prior Publication Data

US 2022/0151849 A1 May 19, 2022

Related U.S. Application Data

(63) Continuation of application No. 17/071,189, filed on Oct. 15, 2020, now Pat. No. 11,273,088, which is a continuation of application No. 15/798,473, filed on Oct. 31, 2017, now Pat. No. 10,842,695, which is a continuation of application No. 14/452,081, filed on Aug. 5, 2014, now Pat. No. 9,827,157, which is a continuation of application No. 11/672,274, filed on Feb. 7, 2007, now abandoned.

(60) Provisional application No. 60/771,318, filed on Feb. 8, 2006.

(51) Int. Cl.

| | |
|---|---|
| ***A61G 7/05*** | (2006.01) |
| ***A47C 21/08*** | (2006.01) |
| ***A47C 21/00*** | (2006.01) |

(52) U.S. Cl.

CPC ..... *A61G 7/0524* (2016.11); *A61G 7/05* (2013.01); *A61G 7/0507* (2013.01); *A47C 21/00* (2013.01); *A47C 21/08* (2013.01)

(58) Field of Classification Search

CPC ..... A61G 7/05; A61G 7/0507; A61G 7/0524; A47C 21/00; A47C 21/08

USPC ..... 5/424, 425, 503.1, 600, 658

See application file for complete search history.

(56) References Cited

U.S. PATENT DOCUMENTS

| | | | |
|---|---|---|---|
| 4,262,872 | A | 4/1981 | Kodet |
| 5,630,238 | A | 5/1997 | Weismiller et al. |
| 5,715,548 | A | 2/1998 | Weismiller et al. |
| 6,163,903 | A | 12/2000 | Weismiller et al. |
| 6,182,310 | B1 | 2/2001 | Weismiller et al. |
| 6,185,767 | B1 | 2/2001 | Brooke et al. |

(Continued)

FOREIGN PATENT DOCUMENTS

| | | |
|---|---|---|
| EP | 3037080 | 6/2016 |
| EP | 3156028 | 4/2017 |

(Continued)

OTHER PUBLICATIONS

International Search Report dated Aug. 2, 2007 (5 pages).

(Continued)

*Primary Examiner* — Robert G Santos

(74) *Attorney, Agent, or Firm* — Barnes & Thornburg LLP

(57) ABSTRACT

A user module for a patient support is provided. The user module is coupled to a patient support barrier, such as a siderail or a footboard.

20 Claims, 36 Drawing Sheets

(56) References Cited

U.S. PATENT DOCUMENTS 6,208,250 B1 3/2001 Dixon et al.
6,226,816 B1 5/2001 Webster et al.
6,320,510 B2 11/2001 Menkedick et al.
6,321,878 B1 11/2001 Mobley et al.
6,336,235 B1 1/2002 Ruehl
6,351,678 B1 2/2002 Borders
6,396,224 B1 5/2002 Luff et al.
6,486,792 B1 11/2002 Moster et al.
6,611,979 B2 9/2003 Welling et al.
6,658,680 B2 12/2003 Osborne et al.
6,680,443 B2 1/2004 Dixon
6,691,346 B2 2/2004 Osborne et al.
6,739,006 B2 5/2004 Borders et al.
6,761,344 B2 7/2004 Welling et al.
6,781,517 B2 8/2004 Moster et al.
6,791,460 B2 9/2004 Dixon et al.
6,820,293 B2 11/2004 Alverson
6,829,796 B2 12/2004 Salvatini et al.
6,880,189 B2 4/2005 Welling et al.
6,924,441 B1 8/2005 Mobley et al.
6,957,461 B2 10/2005 Osborne et al.
6,978,500 B2 12/2005 Osborne et al.
7,017,208 B2 3/2006 Weismiller et al.
7,154,397 B2 12/2006 Zerhusen et al.
7,171,708 B2 2/2007 Osborne et al.
7,213,279 B2 5/2007 Weismiller et al.
7,237,287 B2 7/2007 Weismiller et al.
7,310,839 B2 12/2007 Salvatini et al.
7,454,805 B2 11/2008 Osborne et al.
7,472,439 B2 1/2009 Lemire et al.
7,480,951 B2 1/2009 Weismiller et al.
7,487,562 B2 2/2009 Frondorf et al.
7,568,246 B2 8/2009 Weismiller et al.
7,679,520 B2 3/2010 Zerhusen et al.
7,690,059 B2 4/2010 Lemire et al.
7,779,493 B2 8/2010 Lemire et al.
7,805,784 B2 * 10/2010 Lemire ..... A61G 7/052 108/147
7,834,768 B2 11/2010 Dixon et al.
7,861,334 B2 1/2011 Lemire et al.
7,962,981 B2 6/2011 Lemire et al.
7,978,084 B2 7/2011 Dixon et al.
7,986,242 B2 7/2011 Dixon et al.
8,006,332 B2 8/2011 Lemire et al.
8,104,117 B2 1/2012 Heimbrock et al.
RE43,193 E 2/2012 Osborne et al.
8,117,701 B2 * 2/2012 Bobey ..... A61B 5/6891 5/713
8,258,963 B2 9/2012 Dixon et al.
8,281,433 B2 10/2012 Riley et al.
8,314,781 B2 11/2012 Pittenger et al.
8,393,026 B2 * 3/2013 Dionne ..... A61G 7/08 340/686.1
8,400,311 B2 3/2013 Dixon et al.
8,464,380 B2 * 6/2013 Bobey ..... A61G 7/05776 5/713
8,525,682 B2 9/2013 Dixon et al.
8,544,126 B2 10/2013 Elliott et al.
8,572,778 B2 11/2013 Newkirk et al.
8,584,282 B2 11/2013 Frondorf et al.
8,701,229 B2 * 4/2014 Lemire ..... A61G 7/0527 5/510
8,752,220 B2 6/2014 Soderberg et al.
9,038,217 B2 * 5/2015 Elliot ..... G16Z 99/00 5/617
9,126,571 B2 * 9/2015 Lemire ..... B60T 7/085
9,220,650 B2 * 12/2015 Bobey ..... A61B 5/6891
9,381,125 B2 * 7/2016 Herbst ..... A61G 7/1067
9,539,156 B2 * 1/2017 Lemire ..... A61G 7/08
9,555,778 B2 * 1/2017 Lemire ..... A61G 7/0514
9,642,967 B2 5/2017 Ribble et al.
9,655,798 B2 5/2017 Zerhusen et al.
9,815,439 B2 * 11/2017 Lemire ..... A61G 7/0507
9,827,156 B2 11/2017 Zerhusen
9,827,157 B2 11/2017 Newkirk et al.
10,016,325 B2 7/2018 Ribble et al.
10,052,249 B2 * 8/2018 Elliott ..... G06F 3/04842
10,176,297 B2 1/2019 Zerhusen et al.
10,206,836 B2 2/2019 Zerhusen
10,363,183 B2 7/2019 Ribble et al.
10,381,116 B2 8/2019 Zerhusen et al.
10,413,465 B2 9/2019 Zerhusen et al.
10,512,574 B2 12/2019 Zerhusen et al.
10,517,784 B2 12/2019 Zerhusen et al.
10,561,550 B2 * 2/2020 Bobey ..... A61G 7/05
10,561,552 B2 2/2020 Newkirk et al.
10,709,625 B2 7/2020 Zerhusen et al.
10,842,695 B2 11/2020 Newkirk et al.
11,246,776 B2 * 2/2022 Moreno ..... G06F 3/0488
11,273,088 B2 3/2022 Newkirk et al.
11,382,813 B2 * 7/2022 Moreno ..... A61G 7/0524
2001/0032362 A1 10/2001 Welling et al.
2002/0002742 A1 1/2002 Osborne et al.
2002/0059679 A1 5/2002 Weismiller et al.
2002/0066142 A1 6/2002 Osborne et al.
2002/0080037 A1 6/2002 Dixon et al.
2003/0052787 A1 3/2003 Zerhusen et al.
2003/0061664 A1 * 4/2003 Salvatini ..... A61G 7/0509 5/713
2003/0076238 A1 4/2003 Moster et al.
2004/0034936 A1 2/2004 Welling et al.
2004/0060111 A1 4/2004 Alverson
2004/0128765 A1 7/2004 Osborne et al.
2004/0177445 A1 9/2004 Osborne et al.
2005/0007258 A1 1/2005 Moster et al.
2005/0035871 A1 2/2005 Dixon et al.
2005/0091753 A1 * 5/2005 Salvatini ..... A61G 7/0509 5/713
2005/0166324 A1 8/2005 Dixon et al.
2005/0188462 A1 9/2005 Heimbrock
2006/0075560 A1 4/2006 Osborne et al.
2006/0096029 A1 5/2006 Osborne et al.
2006/0117482 A1 6/2006 Branson
2006/0150332 A1 7/2006 Weismiller et al.
2006/0168729 A1 8/2006 Weismiller et al.
2006/0277683 A1 12/2006 Lamire et al.
2007/0120689 A1 5/2007 Zerhusen et al.
2007/0130692 A1 6/2007 Lemire et al.
2007/0143920 A1 6/2007 Frondorf et al.
2007/0157385 A1 7/2007 Lemire et al.
2007/0163043 A1 * 7/2007 Lemire ..... A61G 7/0516 5/618
2007/0163045 A1 7/2007 Becker et al.
2007/0169268 A1 7/2007 Lemire et al.
2007/0174964 A1 8/2007 Lemire et al.
2007/0174965 A1 8/2007 Lemire et al.
2007/0180616 A1 8/2007 Newkirk et al.
2007/0180618 A1 8/2007 Weismiller et al.
2007/0296600 A1 12/2007 Dixon et al.
2008/0010747 A1 1/2008 Dixon et al.
2008/0052831 A1 3/2008 Weismiller et al.
2008/0172789 A1 7/2008 Elliot et al.
2008/0235872 A1 10/2008 Newkirk et al.
2009/0151073 A1 6/2009 Kramer
2009/0237264 A1 * 9/2009 Bobey ..... A61B 5/6891 5/713
2010/0101022 A1 4/2010 Riley et al.
2010/0125952 A1 5/2010 Frondorf et al.
2010/0154124 A1 6/2010 Zerhusen et al.
2010/0229304 A1 9/2010 Heimbrock et al.
2011/0030141 A1 2/2011 Soderberg et al.
2011/0037597 A1 2/2011 Dixon et al.
2011/0144548 A1 6/2011 Elliott et al.
2011/0162141 A1 * 7/2011 Lemire ..... A61G 7/0506 188/1.12
2011/0210925 A1 9/2011 Pittenger et al.
2011/0214234 A1 9/2011 Herman
2011/0231996 A1 * 9/2011 Lemire ..... A61G 7/0528 5/613
2011/0234408 A1 9/2011 Dixon et al.
2011/0277242 A1 * 11/2011 Dionne ..... A61G 7/0507 5/613
2012/0086575 A1 4/2012 Dixon et al.

(56) References Cited

U.S. PATENT DOCUMENTS

| | | | | |
|---|---|---|---|---|
| 2012/0105233 | A1* | 5/2012 | Bobey | A61G 7/05776 340/573.4 |
| 2012/0291200 | A1 | 11/2012 | Dixon et al. | |
| 2013/0019406 | A1 | 1/2013 | Riley et al. | |
| 2013/0205501 | A1 | 8/2013 | Robertson et al. | |
| 2013/0227787 | A1* | 9/2013 | Herbst | A61G 7/1067 5/618 |
| 2013/0253291 | A1 | 9/2013 | Dixon et al. | |
| 2013/0276237 | A1* | 10/2013 | Bobey | A61G 7/05776 5/658 |
| 2013/0340169 | A1 | 12/2013 | Zerhusen et al. | |
| 2014/0059768 | A1* | 3/2014 | Lemire | B60T 17/22 5/611 |
| 2014/0237721 | A1* | 8/2014 | Lemire | A61G 7/08 188/1.12 |
| 2014/0259410 | A1 | 9/2014 | Zerhusen et al. | |
| 2014/0292529 | A1 | 10/2014 | Zerhusen | |
| 2014/0338124 | A1 | 11/2014 | Newkirk et al. | |
| 2015/0250669 | A1* | 9/2015 | Elliott | G06F 3/04817 5/613 |
| 2016/0095774 | A1* | 4/2016 | Bobey | A61B 5/6891 5/658 |
| 2016/0117450 | A1 | 4/2016 | Zerhusen et al. | |
| 2016/0136356 | A1 | 5/2016 | Ribble et al. | |
| 2016/0287459 | A1* | 10/2016 | Lemire | A61G 7/1046 |
| 2017/0224561 | A1 | 8/2017 | Ribble et al. | |
| 2017/0224562 | A1 | 8/2017 | Zerhusen et al. | |
| 2018/0049932 | A1 | 2/2018 | Zerhusen | |
| 2018/0049933 | A1 | 2/2018 | Newkirk et al. | |
| 2018/0104122 | A9* | 4/2018 | Elliott | A61G 7/015 |
| 2018/0104123 | A1 | 4/2018 | Newkirk et al. | |
| 2018/0161225 | A1 | 6/2018 | Zerhusen et al. | |
| 2018/0296413 | A1 | 10/2018 | Ribble et al. | |
| 2018/0303687 | A1* | 10/2018 | Moreno | G01G 23/42 |
| 2019/0008708 | A1* | 1/2019 | Moreno | G06F 3/0489 |
| 2019/0122765 | A1 | 4/2019 | Zerhusen et al. | |
| 2019/0336368 | A1 | 11/2019 | Zerhusen et al. | |
| 2020/0069491 | A1 | 3/2020 | Zerhusen et al. | |
| 2020/0188204 | A1 | 6/2020 | Newkirk et al. | |
| 2021/0022936 | A1 | 1/2021 | Newkirk et al. | |
| 2022/0151849 | A1* | 5/2022 | Newkirk | A61G 7/05 |

FOREIGN PATENT DOCUMENTS

| | | |
|---|---|---|
| EP | 3207910 | 8/2017 |
| EP | 3569212 | 11/2019 |
| WO | 99/04190 | 1/1999 |

OTHER PUBLICATIONS

International preliminary report on patentability from PCT/US2007/061765 dated Aug. 21, 2008 (10 pages).
Extended EP Search Report dated Feb. 21, 2017 (7 pages).
Communication pursuant to Article 94(3) EPC for European Patent Application No. 16200090.5 dated Dec. 20, 2017 (6 pages).
Communication pursuant to Article 94(3) EPC for European Patent Application No. 16200090.5 dated Aug. 1, 2018 (4 pages).
Communication pursuant to Article 94(3) EPC for European Patent Application No. 16200090.5 dated Dec. 4, 2018 (4 pages).

* cited by examiner

USER MODULE FOR A PATIENT SUPPORT APPARATUS

RELATED APPLICATIONS

This application is a continuation of U.S. application Ser. No. 17/071,189, filed Oct. 15, 2020, now U.S. Pat. No. 11,273,088, which is a continuation of U.S. application Ser. No. 15/798,473, filed Oct. 31, 2017, now U.S. Pat. No. 10,842,695, which is a continuation of U.S. application Ser. No. 14/452,081, filed Aug. 5, 2014, now U.S. Pat. No. 9,827,157, which is a continuation of U.S. application Ser. No. 11/672,274, filed Feb. 7, 2007, now abandoned, which claimed the benefit of U.S. Provisional Application No. 60/771,318, filed Feb. 8, 2006, and each of which is incorporated herein by this reference.

This application is related to Patent Cooperation Treaty Patent Application No. PCT/US2007/061765, entitled USER MODULE FOR A PATIENT SUPPORT, filed Feb. 7, 2007, and which is incorporated herein by this reference.

BACKGROUND

Patient supports, such as hospital beds, stretchers, operating room tables, and the like, are commonly used in a variety of care environments to facilitate patient care and transport.

User modules are often provided to enable a user to perform a variety of automated functions relating to a patient support. Examples of such automated functions include raising or lowering one or more sections of the patient support, adjusting the configuration of a bed frame or mattress or portion thereof, and activating or deactivating selected therapies, alarms, communications, and other automated features of the patient support. As such, user modules may be operably coupled to a bed or mattress controller or control system, a remote computer, an air supply or other like service supply.

Many conventional user modules are either fixed in a siderail of the patient support, or are provided as pendants that may be stored in the siderail and removed from the siderail for use. However, many conventional patient support user modules are cumbersome for a caregiver, patient, or technician to use due to poor ergonomic positioning or design.

Particularly with graphic displays, such as touchscreen displays, poor ergonomic positioning or design can result in an undesirable angle between the user and the user module, which makes the controls on the user interface difficult to see and operate.

Poor ergonomic design or positioning of the user module can also make the user module itself difficult or cumbersome to use. For example, two hands may be required, with one hand being used to steady the module while the other hand operates the user interface.

In addition, the method of attachment of the user module to the patient support (i.e., by linkages, arms, wires, cords and the like) and location of such attachments may require the user to bend down, reach across the body, or assume some other uncomfortable position in order to access and use the module.

SUMMARY

In one embodiment of the present invention, a patient support apparatus including a siderail is provided. The siderail has a first end, a second end spaced from the first end, a top edge and a bottom edge defining a periphery of the siderail, a vertical axis extending substantially perpendicular to the top edge of the siderail, and a first user module positioned within the periphery of the siderail at an angle in the range of about 5-30 degrees from the vertical axis.

The first user module may include a touchscreen display. The touchscreen display may be positioned at an angle in the range of about 10-15 degrees from the vertical axis. The patient support apparatus may include a second user module located adjacent the first user module within the periphery of the siderail. The second user module may include at least one hardpanel control. The second user module may be positioned at an angle of about 0 degrees from the vertical axis.

In another embodiment of the present invention, a patient support apparatus is provided, including at least one siderail. The siderail may include a top portion, a bottom portion spaced from the top portion, a first end and a second end spaced from the first end, a recessed area defined by a back panel and at least two indented sides, and a non-recessed area, a vertical axis extending substantially perpendicular to the top portion of the siderail, and a touchscreen user interface positionable within the recessed area at an angle greater than 0 degrees with respect to the vertical axis.

The patent support apparatus may include a non-touchscreen user interface provided on the non-recessed area. The touchscreen user interface may be pivotably coupled in the recessed area. The patient support apparatus may include at least one bumper located adjacent the recessed area. A touchscreen user interface may be provided in a housing having a top portion, a bottom portion spaced from the top portion, a first side and a second side spaced from the first side. A pivot coupler pivotably coupling the top portion of the housing in the recessed area of the siderail may be provided. A bottom portion of the user interface housing may include a concavely shaped edge.

In another embodiment of the present invention, a patient support apparatus including at least one siderail is provided. The siderail includes a first end, a second end spaced from the first end, and a docking region located between the first and second ends. At least one guide track is located in the docking region. A user module including a touchscreen display is also provided. The user module includes a guide bar configured to be slidably received by the guide track.

The docking region may be a recessed area defined by a back panel and two opposing sides, and the guide track may be located on one of the sides. The guide track may include an angled portion sized to receive the guide bar to position the user module at an acute angle with respect to a vertical axis of the siderail.

In another embodiment of the present invention, a patient support apparatus is provided. The patient support apparatus includes a base, a frame supported by the base, the frame having first and second spaced longitudinal sides and first and second spaced ends, a first barrier positionable along one of a side and an end, a second barrier positionable along one of a side and an end, a first user module docking region located in the first barrier, and a second user module docking region located in the second barrier.

The first and second barriers may be siderails positionable along the first and second sides of the frame. The first barrier may be a siderail and the second barrier may be a footboard. The first docking region may be configured to receive a first user module including a touchscreen user interface and the second docking region may be configured to receive a second user module including a non-touchscreen user interface. At least one of the first and second user modules may be detachable from a docking region. At least one of the docking regions may be a recessed area including a back panel. A mating connector including electrical contacts may be coupled to the back panel.

In another embodiment of the present invention, a user module for a patient support is provided. The user module includes a housing having a first side and a second side opposite the first side, a first user interface located on the first side, and a second user interface located on the second side.

The first user interface may include a touchscreen and the second user interface may include at least one hardpanel control. The user module may include a coupling region to pivotably couple the housing to a siderail.

In accordance with another embodiment of the present invention, a patient support apparatus is provided. The patient support apparatus includes an adjustable-length arm assembly, a user module including a user interface, the user module being pivotably coupled to a first end of the arm assembly, and a pivot coupler to pivotably couple a second end of the arm assembly to a bed frame.

The second end of the arm assembly may be coupled to a footboard. The arm assembly may include a first arm portion and a second adjustable-length arm portion.

BRIEF DESCRIPTION OF THE DRAWINGS

The detailed description particularly refers to the following figures in which.

DETAILED DESCRIPTION OF THE DRAWINGS

The present disclosure refers to a number of illustrative embodiments shown in the accompanying drawings and described herein.

Figure 1:
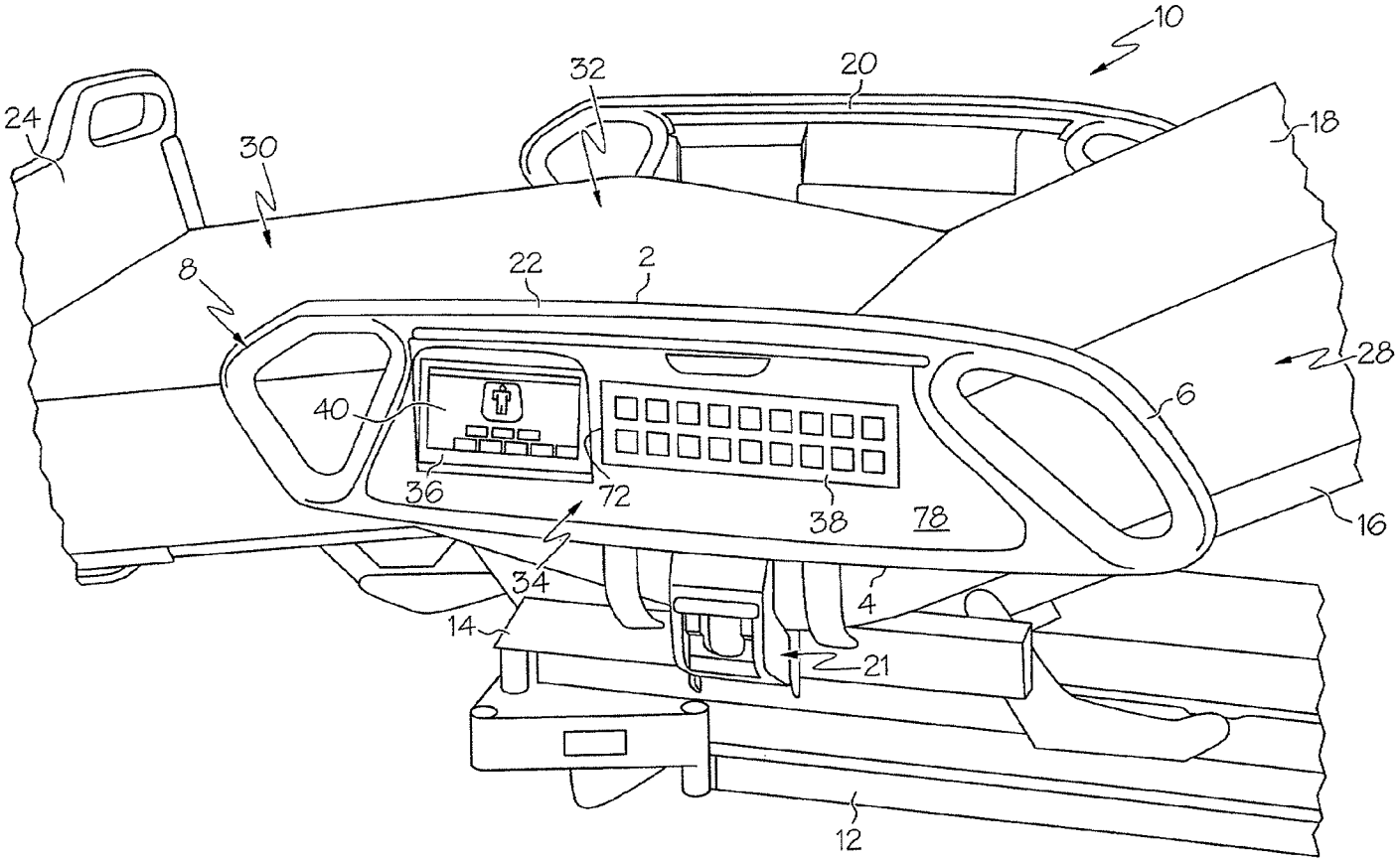
FIG. 1 is a perspective view of one embodiment of a siderail of an exemplary patient support in accordance with the present invention, including at least one user module.
Figure 2:
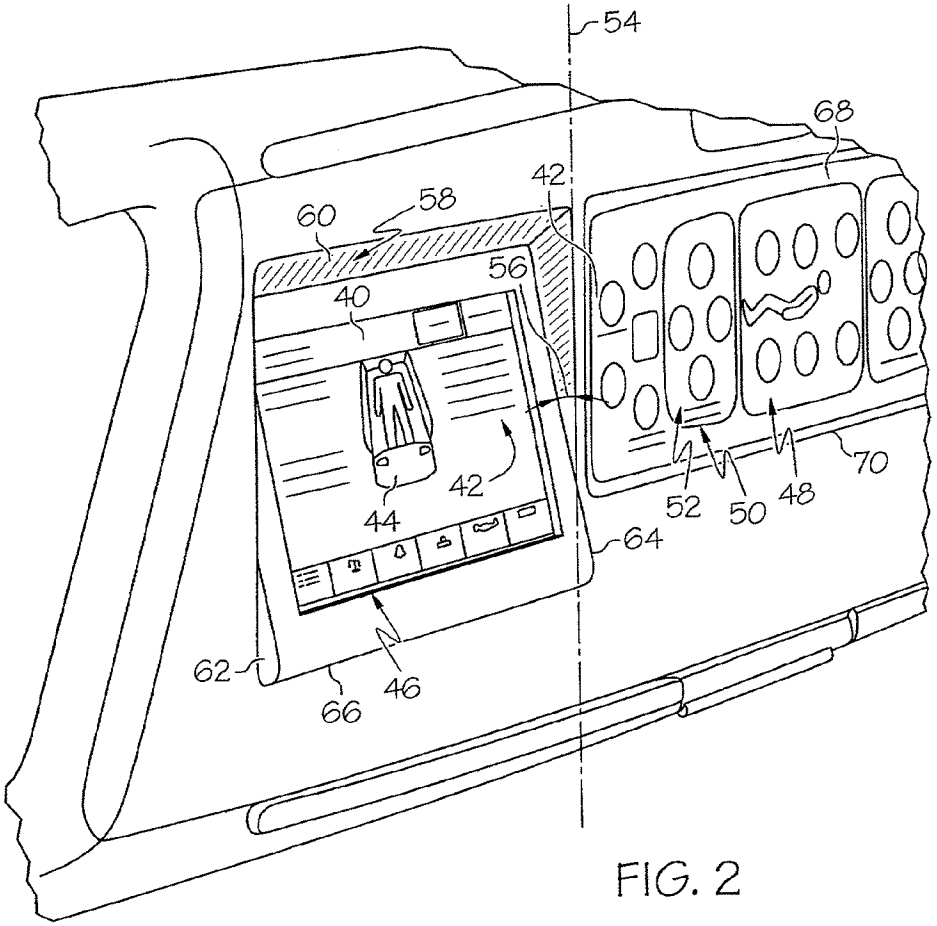
FIG. 2 is a perspective view of a portion of the siderail of FIG. 1, showing a first user module and a portion of a second user module provided therein.
Figure 3:
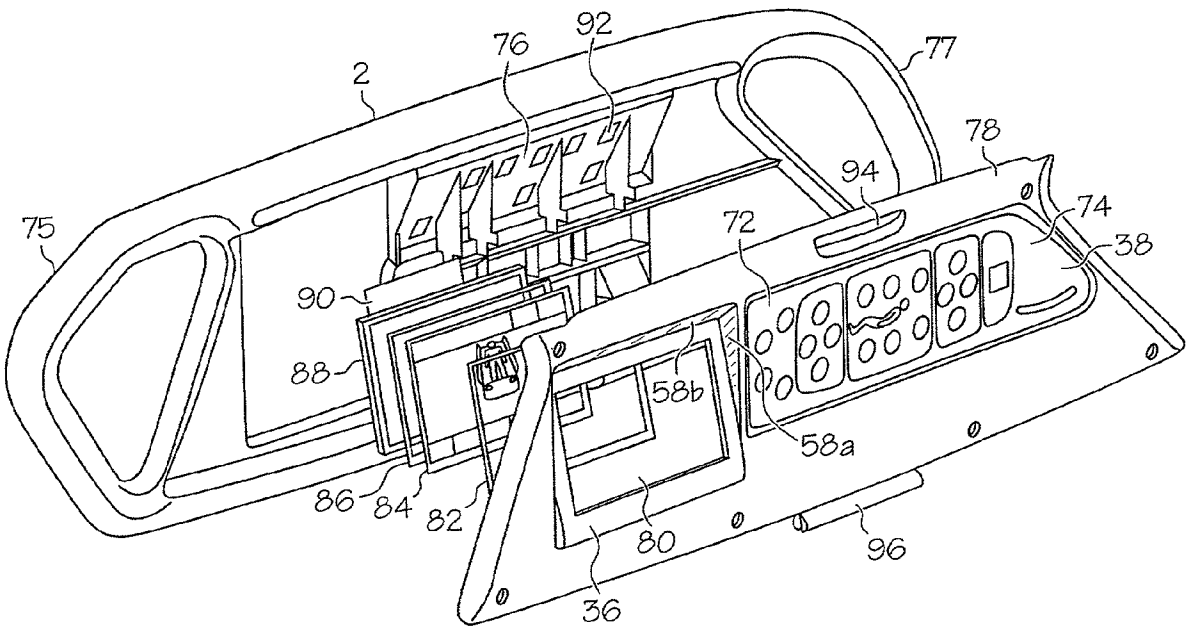
FIG. 3 is an exploded view showing components of the siderail of FIG. 1.

FIGS. 1-3 illustrate one embodiment of a siderail including a first user module 36 and a second user module 38. As shown in FIG. 1, a patient support apparatus or hospital bed 10 includes a mattress 18 supported by a deck 16. Deck 16 is coupled to a frame 14, which is supported by a base 12. Support surface or mattress 18 generally includes a cover defining an interior region which includes one or more support members for supporting the weight of a patient, such as foam, air bladders, three-dimensional material and the like. Deck 16 may include one or more articulating deck sections to provide adjustment of a patient's position on the bed, for example, to elevate a patient's head or to move the bed into a chair-like configuration. Frame 14 may include vertical adjustment members to raise and lower the position of the deck 16 or sections thereof with respect to the floor. Base 12 may be supported by casters to facilitate movement or transport of patient support 10.

The illustrated patient support 10 has a head section 28, a foot section 30 and a seat section 32. Barriers 20, 22 and 24 are positionable around the perimeter or periphery of the patient support 10 to aid in retaining a patient within the boundaries of the mattress 18 or for other reasons. Barriers 20, 22, 24 include a footboard 24 and a pair of siderails 20, 22. Footboard 24 is positioned adjacent the foot end 30 and each siderail 20, 22 is positioned generally adjacent the seat section 32 on either side of the mattress 18. A headboard barrier may also be provided adjacent the head end 28.

One or both of siderails 20, 22 may include one or more user modules 36, 38 facing generally outwardly away from the mattress 18 to enable a user, such as a caregiver or technician, to activate, adjust or deactivate various functions or capabilities of patient support 10. One or more other similar such modules may be provided facing generally inwardly toward the mattress 18 to enable a patient to activate, adjust or deactivate certain bed functions or capabilities from his or her position on the bed 10. In general, user modules 36, 38 include a key lock, password protection, or other similar suitable method for preventing access to the various controls by unauthorized or unintended users. At least user module 36 is located nearer to foot end 30 than to head end 28 of the patient support as shown.

In the illustrated embodiment, siderail 22 includes a top edge 2, a bottom edge 4, first and second sides 6, 8, and a first or front panel 78. A first user module 36 and a second user module 38 located adjacent to first user module 36 are provided within the front panel 78. Siderail 22 may be raised to the illustrated use position, wherein top edge 2 is positioned above the mattress 18, or lowered to a storage position, via a lift mechanism 21.

As shown in FIG. 2, first user module 36 has a dynamic display 40 including one or more of text 42, graphics 44 and switches or controls or buttons 46. Dynamic display 40 includes animation or can otherwise change automatically depending on or in response to the particular bed function or capability being activated, adjusted or deactivated. In the illustrated embodiment, dynamic display 40 includes a touchscreen.

Second user module 38 includes one or more of non-dynamic or "hard panel" switches or controls or buttons 48, text 50, and graphics 52.

First user module 38 had a top edge 60, a bottom edge 66, and first and second sides 62, 64. As shown in FIG. 2, top portion 60 of first user module 38 is recessed in front panel 78 of siderail 22 by the depth of the indentation or recess 58 (defined by indentations 58*a*, 58*b* as shown in FIG. 3), while bottom portion 66 is not recessed. As a result, user interface 40 is set at a fixed angle 56 from the vertical axis 54.

Fixed angle 56 is an acute angle configured so that user interface 40 is generally angled for increased visibility by a person standing next to the patient support 10. Fixed angle 56 may be in the range of zero to forty-five or even ninety degrees from the vertical axis 54. However, fixed angle 56 may be influenced or determined by the thickness or amount of interior region space between the siderail housing portions 76, 78 when siderail 22 is assembled. In the illustrated embodiment, fixed angle 56 is in the range of about 10-15 degrees from the vertical axis 54.

As shown in FIG. 3, siderail 22 includes a first or front panel or housing portion 78 and a second or back panel or housing portion 76. In the illustrated embodiment, each of front and back panels 76, 78 is a single molded plastic piece. Back panel 76 is formed to include first and second handles 75, 77. Back panel 76 also illustratively includes one or more apertures 92 for a patient-side user interface, controls, buttons or switches as described above.

The components of dynamic display 40 are located within the interior region or space defined by panels 76, 78 when the siderail is assembled. These components include touchscreen 84, liquid crystal display (LCD) or similar display 88, control board 90 and gaskets 82, 86, which are sandwiched between panels 76, 78 so that touchscreen 84 is visible through aperture 80. Control board 90 includes electronics and circuitry for operating dynamic display 40. Control electronics board 90 is located within the interior region of the siderail, along with the other display components, as shown in FIG. 3.

Front panel 78 illustratively includes a handle or grip 94 and a bumper or protective strip 96. Handle 94 is a recess or indented region molded into the panel 78. Bumper 96 is a molded bar that may extend along the entire bottom edge of the front panel 78.

Second user module 38 has a first side 72 generally adjacent the first side 64 of the first user module, and a second side 74 spaced therefrom. Nondynamic or hardpanel controls, graphics and text 48, 50 and 52 are provided within the region between first and second sides 72, 74 in the illustrated embodiment.

Hard panel display elements 48, 50, 52 may be applied to front panel 78 by adhesive or other suitable attachment mechanism. Hard panel elements 48, 50, 52 may be provided on a single overlay piece or strip of plastic or other similar suitable material which is then applied to front panel 78.

Electrical circuitry relating to hardpanel controls or switches 48 is located in the interior region defined by panels 76, 78. One or more of first and second user modules 36, 38 may include an internal battery or similar power supply, and/or may be connected to a computer or control system by a wireless network.

If necessary, wiring connecting each of the first and second user modules 36, 38 to a power supply and/or mattress controller or patient support control system is generally routed below siderail 22 and under mattress 18 and/or deck 16. For example, a main control/supply may be located within frame 14 or base 12 and wiring may be routed through one or more channels in the siderail lift mechanism 21.

FIGS. 4-9 illustrate an embodiment of a siderail 100 including a movable user module 110. Siderail 100 has a top edge 102, a bottom edge 104 spaced from the top edge 102, a first end 106 and a second end 108 spaced from the first end 106. A first user module 110 and a second user module 112 are included generally within the area bounded by top and bottom edges 102, 104 and first and second ends 106, 108.

Figure 4:
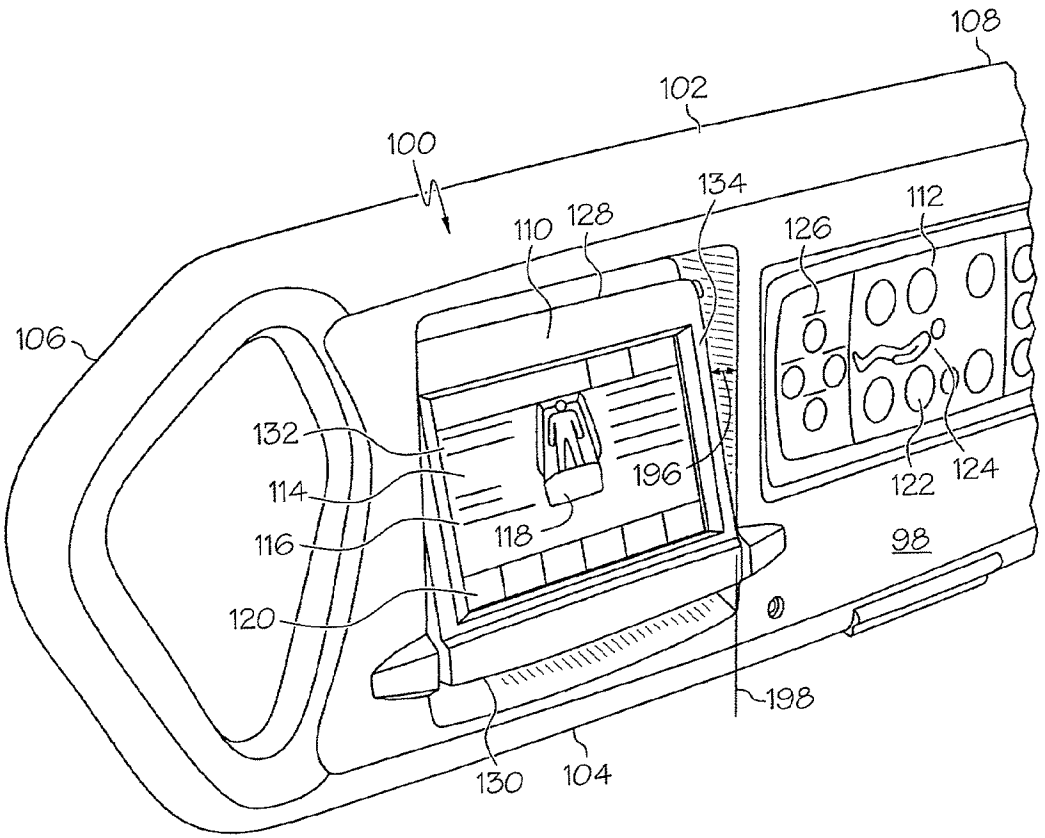
FIG. 4 is a perspective view of a portion of another embodiment of a siderail in accordance with the present invention, including a movable user module, showing the user module in a first position.

First user module 110 has a top edge 128, a bottom edge 130, a first side 132 and a second side 134. A display 114 is provided generally within the area bounded by top and bottom edges 128, 130, and first and second sides 132, 134. In the illustrated embodiment, display 114 is a dynamic display. Display 114 may include text 116, graphics 118 and/or one or more controls or switches or buttons 120 as shown in FIG. 4. In the illustrated embodiment, controls 120 are touchscreen controls and are located at the bottom end of the display 114 to facilitate single handed use of the module 110 by a user. For example, a user may use a thumb to activate the touchscreen controls while simultaneously holding the module up with the same hand.

Second user module 112 generally includes one or more nondynamic or hardpanel controls or buttons or switches 122. Second user module may include graphics 124 and/or text 126 as shown in FIG. 4.

Siderail 100 includes a front panel 98. A recessed area bounded by indented sides 140, 141, 142, 144 and back wall 138 is sized to receive and house the first user module 110 within the siderail 100 adjacent front panel 98. The depth of the recessed area 138, 140, 142, 144 may be influenced or determined by the thickness 194 of the siderail 100 and/or the thickness 164 of the first user module 112.

In a first or storage position, the back portion 162 of first user module 110 rests adjacent back panel 138 in such a way that top edge 128 is set deeper into the recess than bottom edge 130, resulting in display 114 being angled slightly upwardly for easier viewing by a user standing near the siderail 100. The resulting angle 196 between first user module 110 and vertical axis 198 of front panel 98 is generally in the range of 0 to 90 degrees from vertical axis 198. The maximum angle 196 may be determined or influenced by the depth or thickness 194 of the siderail housing. In the illustrated embodiment, when first user module 110 is in the first or storage position, angle 196 is between about 10-20 degrees from the vertical axis 198 (i.e. 70-80 degrees from horizontal).

Figure 5:
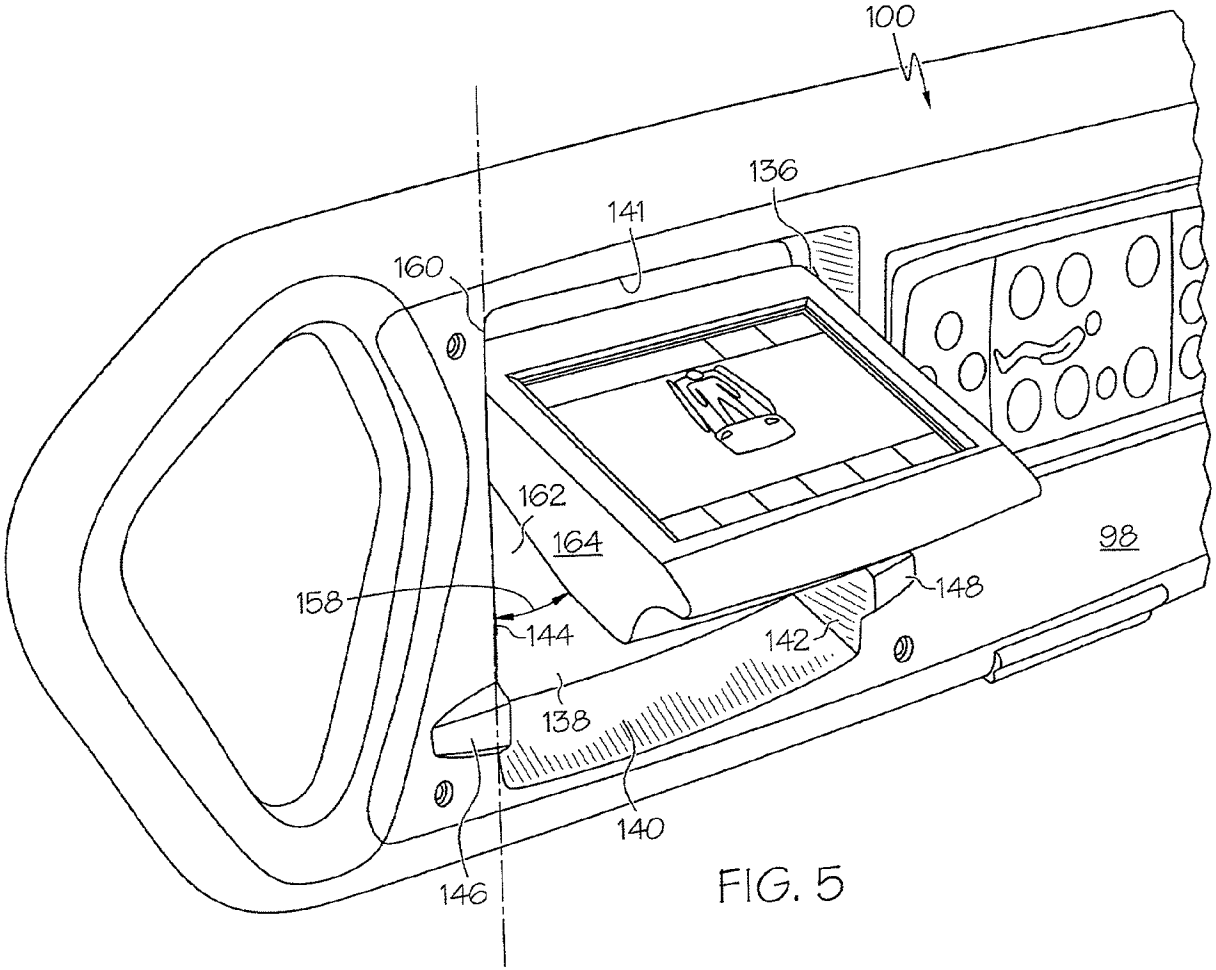
FIG. 5 is a perspective view of a portion of the siderail of FIG. 4, showing the user module in a second position.
Figure 6:
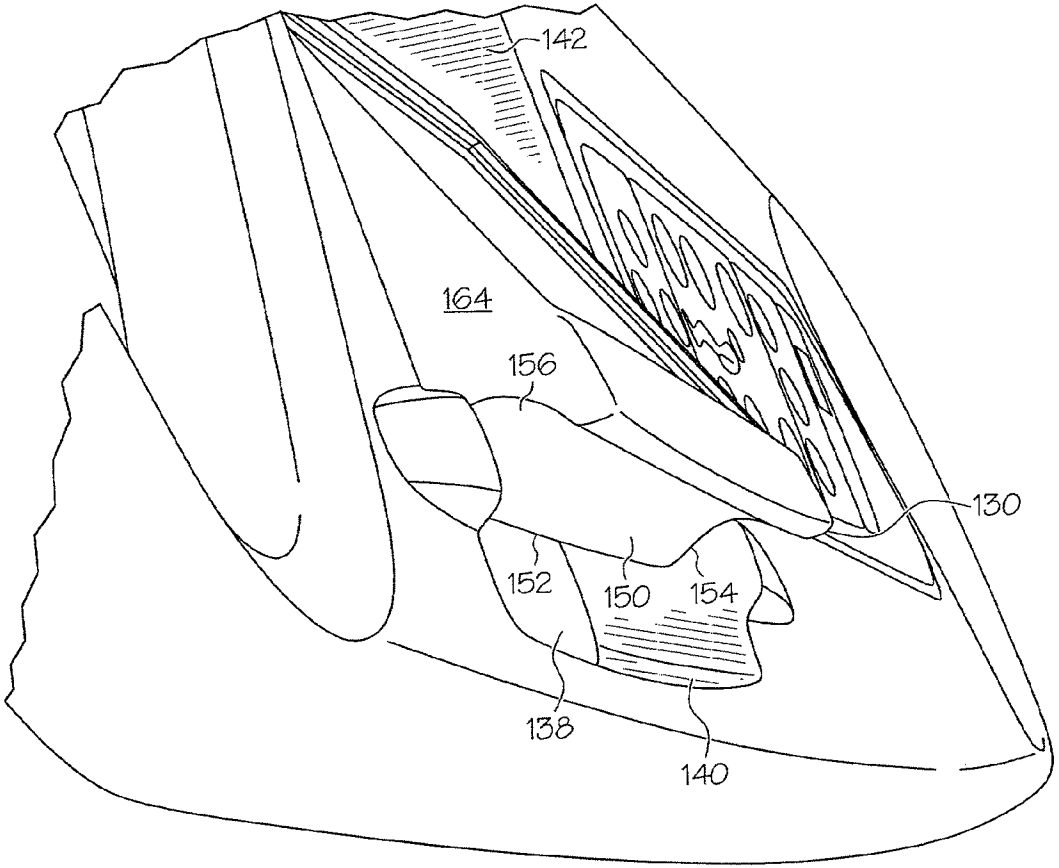
FIG. 6 is another partial perspective view of the siderail of FIG. 4, showing a bottom portion of the user module.
Figure 7:
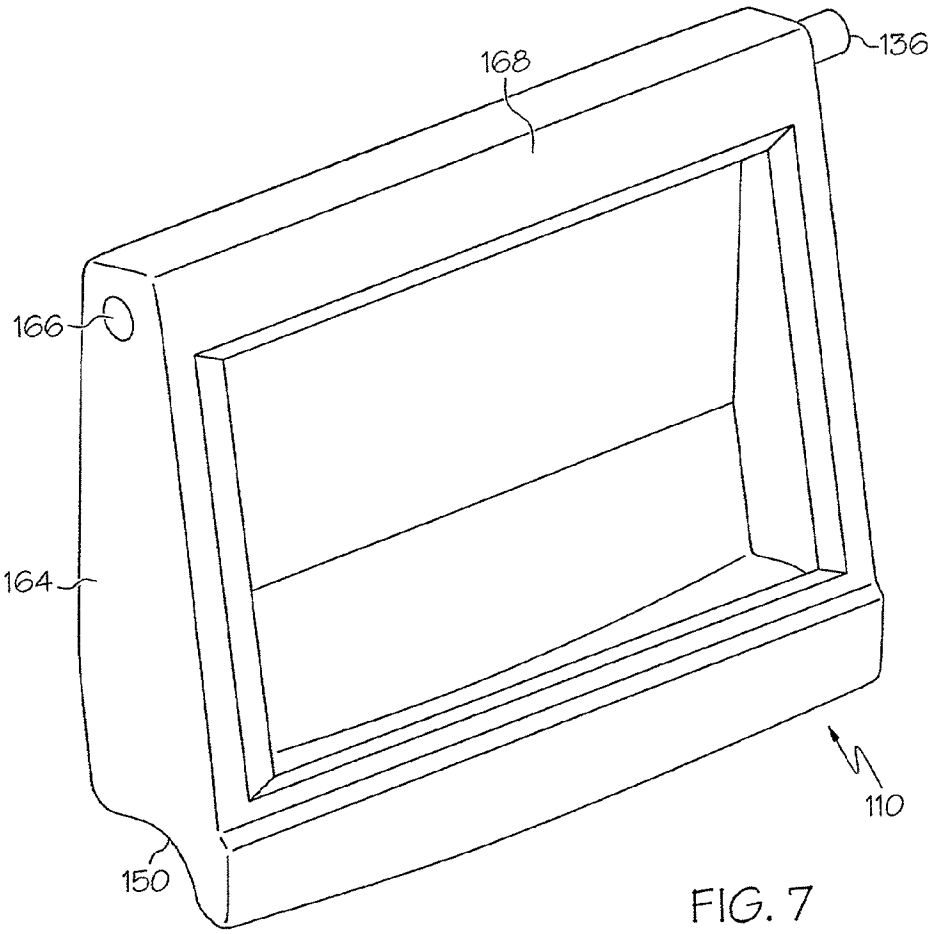
FIG. 7 is a front perspective view of a portion of the housing of the user module of FIG. 4.

As shown in FIG. 5, first user module 110 is movable with respect to front panel 98 of the siderail 100. A pivot coupling mechanism 136, 166 is provided adjacent the top edge 128 of the first user module 110. First user module 110 rotates upwardly away from back panel 138 around an axis extending from pivot coupler 136 along the top portion 128 of the first user module to pivot coupler 166. In a second or use position, back portion 162 is positioned at an angle 158 with respect to vertical axis 160. Angle 158 is adjustable by a user, i.e., by lifting bottom portion 130 upwardly away from front panel 98. Angle 158 is generally in the range of 0 to 90 degrees from the vertical axis 160. In the illustrated embodiment, the maximum viewing angle 158 is about thirty degrees. In this way, first user module 110 may be stowed within the siderail 100 when not in use, particularly when the siderail or patient support is being transported down crowded hallways or through narrow doorways or passages. In addition, first user module 110 may be rotated upwardly with respect to the siderail 100 to facilitate easier use by a caregiver, technician, or other user.

Bottom edge 130 of first user module 110 intersects curved side edges 156, which together with back edge 152 define the boundaries of a substantially concave bottom surface 150. Concavely shaped bottom surface 150 is configured to facilitate gripping or handling by a user to lift and rotate and the first user module 110 upwardly.

Figure 9:
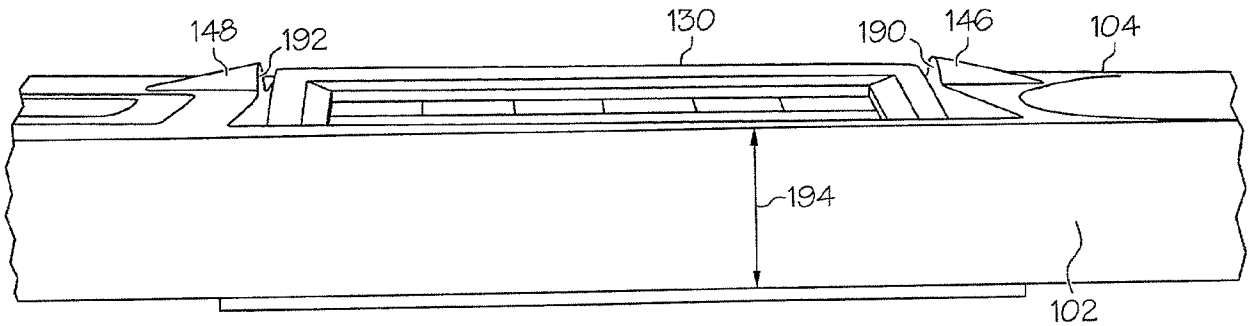
FIG. 9 is a top perspective view of a portion of the siderail of FIG. 4 including bumpers.

Bumpers 146, 148 are provided on front panel 98 on either side of the recessed area defined by back panel 138 and indented sides 140, 141, 142, 144. Bumper 146 is positioned generally adjacent first side 132 of user module 110 and bumper 148 is positioned generally adjacent second side 134 of user module 110. Bumpers 146, 148 extend generally outwardly away from front panel 98. Bumpers 146, 148 may be molded into panel 98 or may be attached thereto by adhesive, screws or other suitable fasteners or fastening mechanism. As shown in FIG. 9, bumpers 146, 148 have three surfaces, two sides angled outwardly supporting a front face which extends outwardly away from front panel 98 by a distance that at least exceeds the distance of bottom edge 130 away from front panel 98. In this way, bumpers 146, 148 may be configured to protect user module 110 from damage during transport of siderail 100, for example.

In the illustrated embodiment, pivot coupling mechanism 136, 166 is provided behind front face 168 of user module 110. Pivot coupler 166 is an aperture that receives a corresponding pin or similar protrusion extending outwardly from side 144 of the recessed area of the siderail. Pivot coupler 136 is a hollow pivot boss configured to receive a pivot arm 188, a portion of which is secured in the interior region of the siderail 100 behind side 142. Electrical wiring, e.g. for power, data, and/or network connections, may be routed through the hollow portion of pivot coupler 136 and through the interior region of the siderail to a destination located within the patient support as needed.

Figure 8:
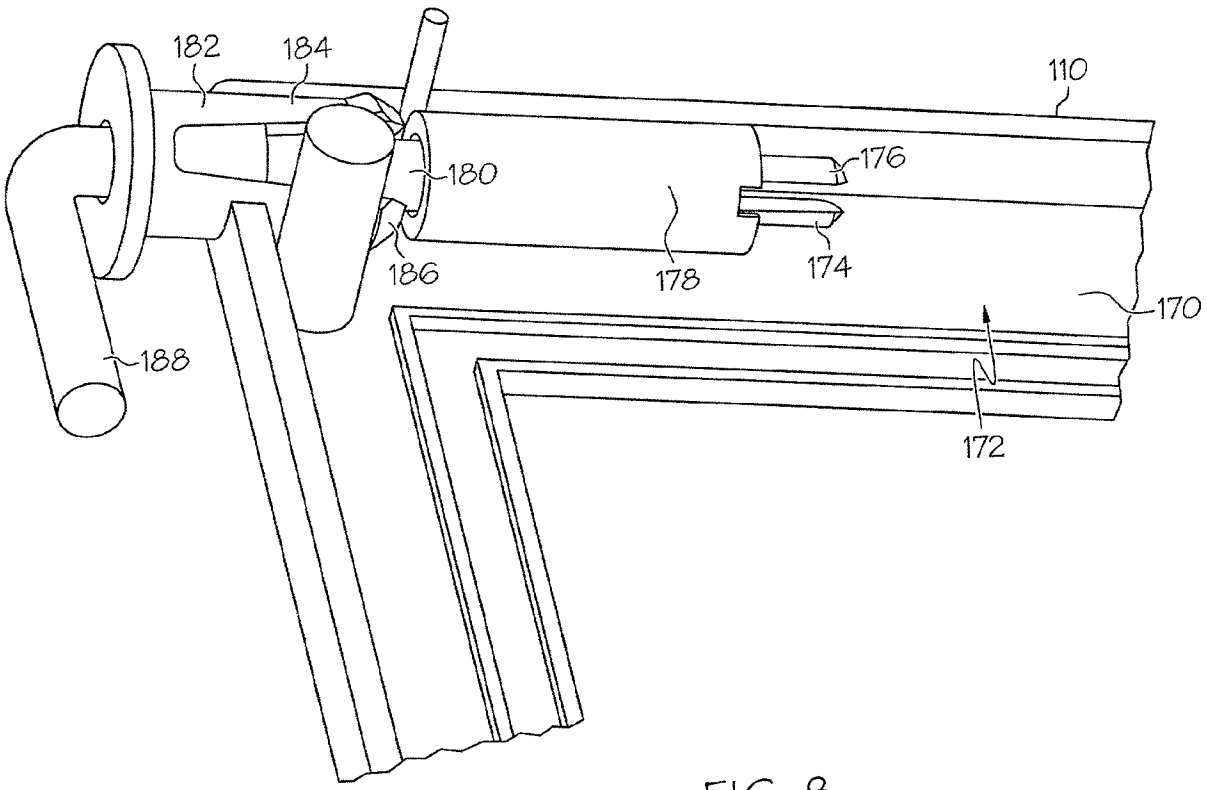
FIG. 8 is a perspective view of a portion of the interior region of the housing of the user module of FIG. 4 including an illustrative embodiment of a pivot coupler.

Any suitable pivot coupling mechanism may be used, including a conventional spring pivot mechanism. One embodiment of a suitable pivot coupler is shown in simplified form in FIG. 8. Arm or protrusion 188 extends into housing 170 and includes arm portion 180 and arm prongs 174, 176. Pivot coupler 136 as shown in FIG. 8 includes a first body portion 182, and a second body portion 178 located in the interior region 172 of the user module 110 and secured therein proximate the back side 170 of the front face 168. First body portion 182 includes prongs 184, 186. Prongs 184, 186 and second body portion 178 receive arm portion 180 in a manner that allows first body portion 182 and second body portion 178 to rotate around arm portion 180. A spring may be positioned between body portions 182, 178 so that upwardly rotation of the housing 170 away from the siderail winds the spring. Second body portion 178 surrounds arm portion 180 and may include a notch or stop (not shown) which may be positioned with respect to prongs 174, 176 to limit the range of rotation of the housing 170.

Figure 10:
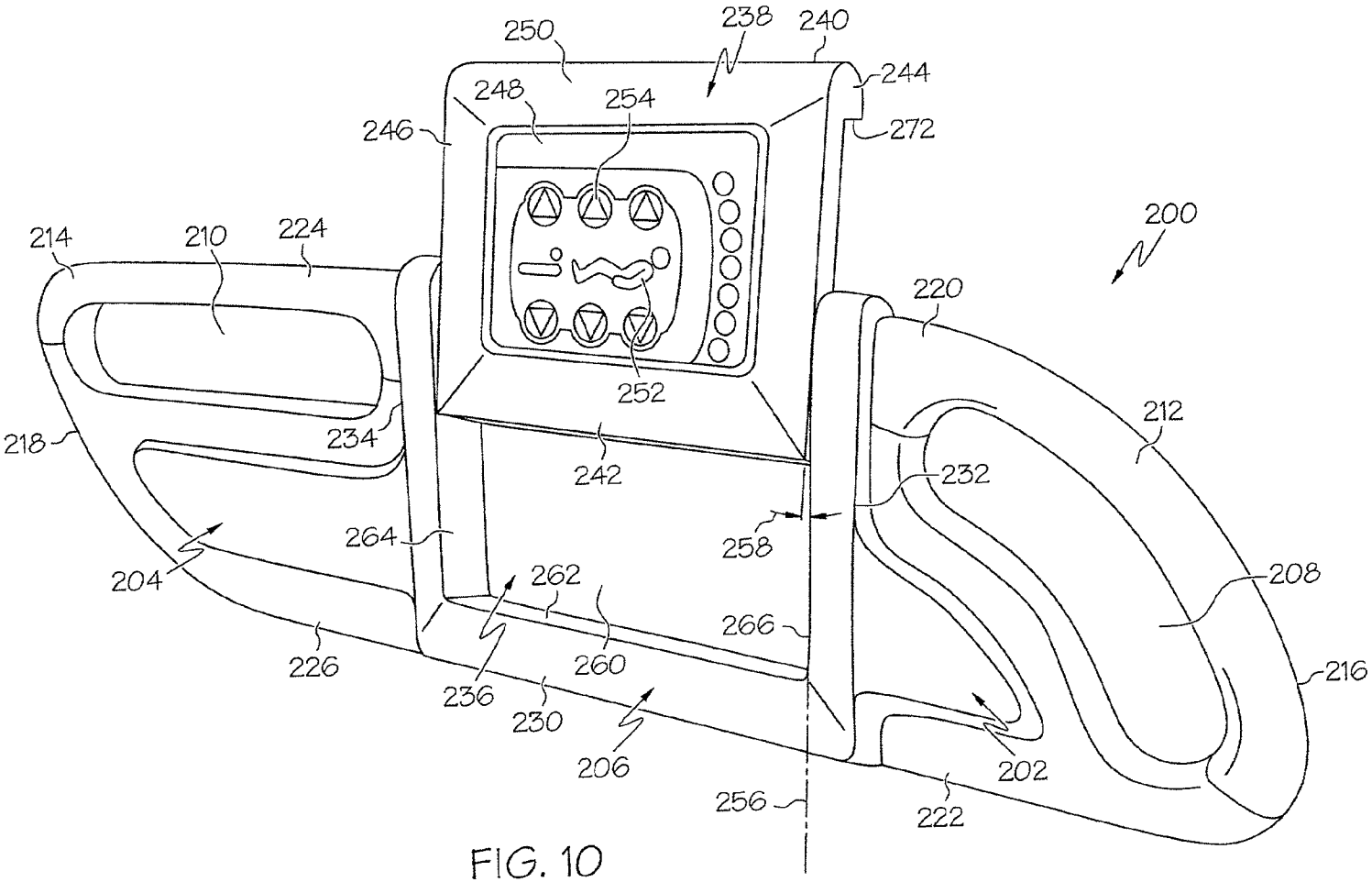
FIG. 10 is a perspective view of a first side of another embodiment of a siderail in accordance with the present invention, including a movable user module shown in a first position.

FIGS. 10-13, 14A-14C, and 15-16 illustrate embodiments of a siderail 200 including a movable and/or detachable user module 238. As shown in FIG. 10, siderail 200 includes first, second and third housing portions 202, 204, 206. First housing portion includes an aperture 208 defining a handle or grip region 212, and second housing portion 204 similarly includes an aperture 210 defining a handle or grip region 214. Handle 212 is located proximate a first end 216 of siderail 200 and handle 214 is located proximate a second end 218 of siderail 200.

First siderail portion 202 has a top portion 220 and a bottom portion 222, and likewise, second siderail portion 204 includes a top portion 224 and a bottom portion 226.

A third siderail portion 206 is located between first and second ends 216, 218. Third siderail portion 206 has a top portion 228 and a bottom portion 230, as well as first and second sides 232, 234. A mounting or docking region 236 is provided generally between first and second sides 232, 234 of third siderail portion 206. Docking region 236 is, in the illustrated embodiment, a recessed area defined by back panel 260 and indented sides 262, 264 and 266.

User module 238 has a top edge 240 and a bottom edge 242, as well as first and second sides 244, 246. Housing front face 250 includes an aperture sized to display a user interface area 248. User interface area 248 includes graphics 252 and controls or switches or buttons 254, and may also include text although not shown in the illustrated embodiment. User interface area 248 may include a dynamic display such as a touchscreen, and/or a nondynamic or hardpanel display as described above.

In FIG. 10, user module 238 is shown in a first or use position wherein a portion of the user module 238 is raised above the top portion 228 of the siderail 200. Docking region 236 is configured such that when user module 238 is in the use position, user module 238 is tilted so that bottom edge 242 of the user module 238 is positioned at an angle 258 with respect to a vertical axis 256 of the siderail 200 to improve viewability of the user interface 248 by a person standing near the siderail and facing user interface 248. Angle 258 may be in the range of 0-90 degrees from the vertical axis 256. In the illustrated embodiment, angle 258 is in the range of about 10-15 degrees from the vertical axis 256. The tilt angle 258 may be limited or influenced by the depth of the docking region defined by sides 262, 254, 266 and/or the thickness of the user module sides 244, 246.

User module 238 includes an edge or stop 272 proximate the top portion 240, which abuts a stop edge 286 of the third portion 206 of the siderail 200 when the user module 239 is in the storage position.

Figure 11:
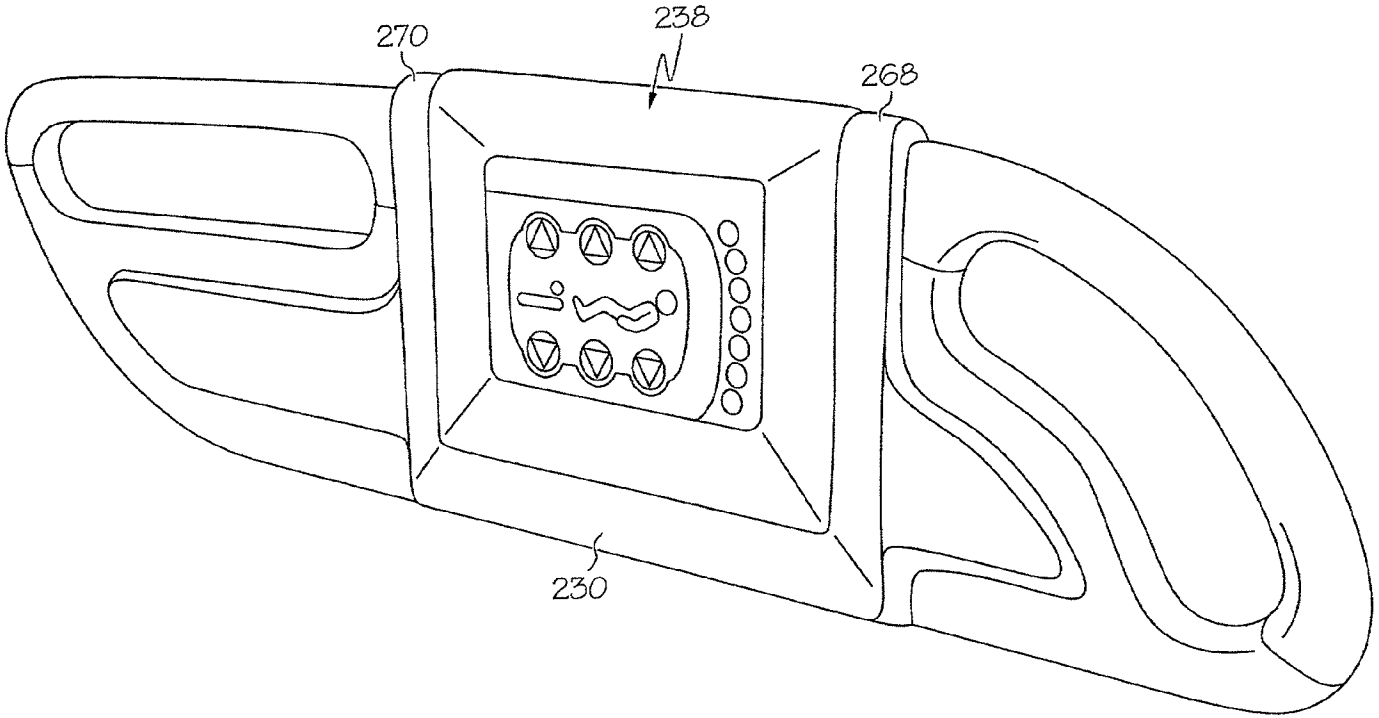
FIG. 11 is a perspective view of the siderail of FIG. 10, showing the user module in a second position.
Figure 12:
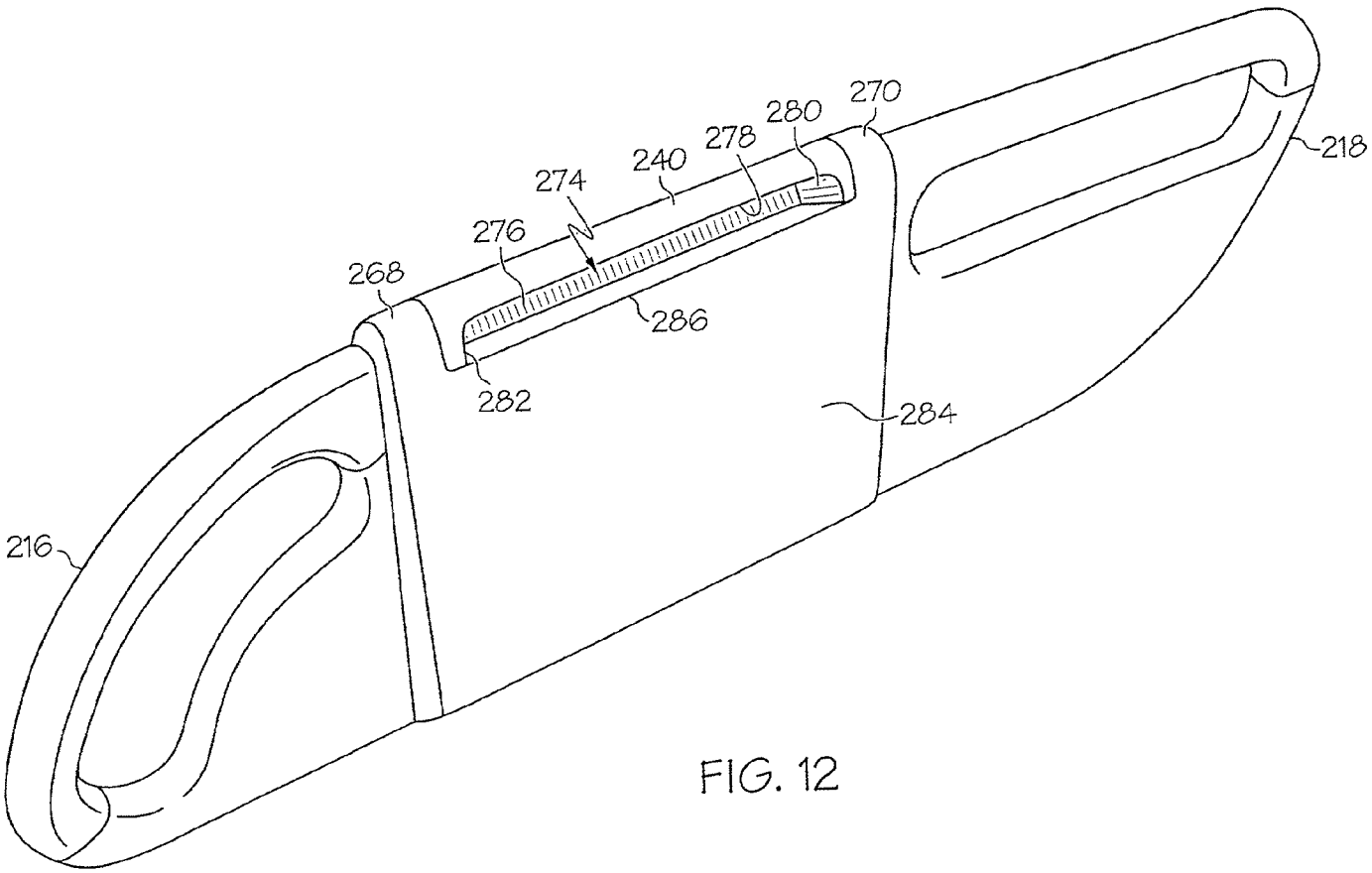
FIG. 12 is a perspective view of a second side of the siderail of FIG. 10.

Third portion 206 of siderail 200 includes guide portions 268, 270 as shown in FIGS. 11-12. FIGS. 11-12 show user module 238 in a second or storage position. In the second or storage position, user module 238 is not tilted at an angle but is instead more or less flush with the vertical axis 256 of the siderail 200. Bottom edge 242 of user module 238 is adjacent bottom portion 230 of the third portion 206 of the siderail 200 when user module 238 is in the storage position.

Side 244 has dimensions, i.e., a thickness such that if user module 238 is tilted up when siderail 200 is moved from the up/use position to the down/storage position, side 244 slightly contacts the patient support mattress and is thereby gently urged to slide into its storage position in the recess 236.

FIG. 12 shows the second or back side of siderail 200 including back panel 284 of the third portion 206. In the embodiment of FIG. 12, top portion 240 of user module 238 includes a handle or grasp area 274, which is defined by indented sides 280, 282, top wall 278, and back wall 276. In this embodiment, bottom portions of sides 280, 282 abut stop edge 286 of the siderail portion 206 when the user module 238 is in the storage position.

Figure 13:
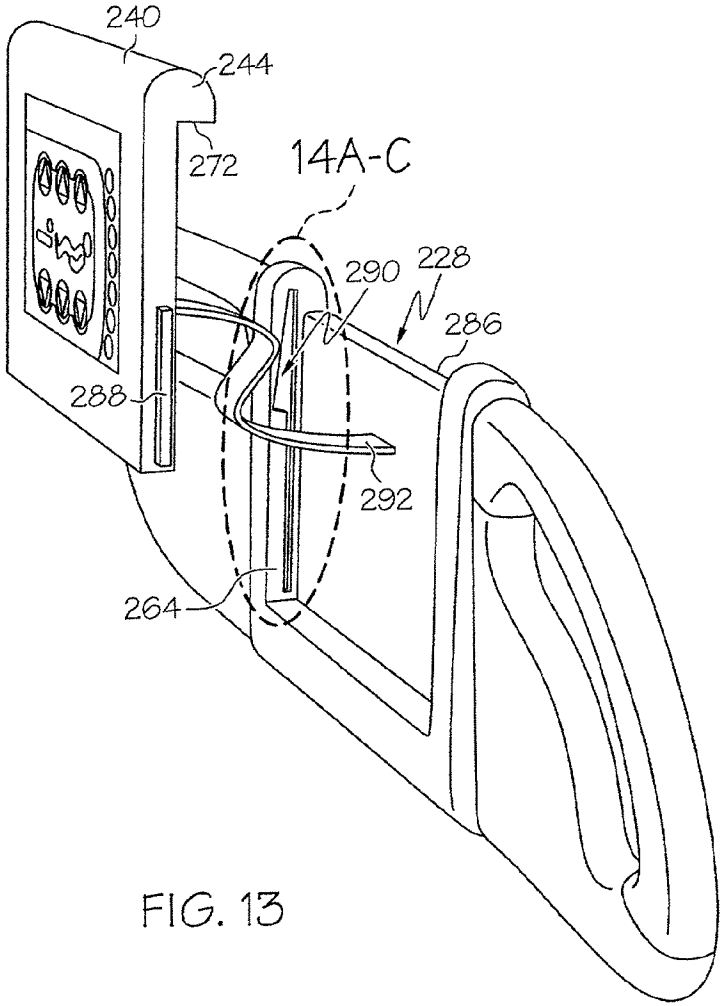
FIG. 13 is a side perspective view of an embodiment of a siderail similar to FIG. 10, showing a user module spaced apart from the siderail.

In the embodiment of FIG. 13, a ribbon or coupler 292 connects electrical circuitry of user module 238 to electrical circuitry of the patient support. In other embodiments, ribbon 292 is replaced by electrical contacts (similar to the illustration of FIG. 19, for example), or a wireless network connection may be used.

As shown in FIGS. 13 and 14A-14C, user module 238 is generally slidably coupled to docking region 236. User module 238 may slide vertically upwardly and downwardly in docking region 236 by virtue of guide bars 288 located on either side 244, 246 of user module 238 being slidably received by guide tracks 290 located on either side 264, 266 of docking region 236.

Figure 14A:
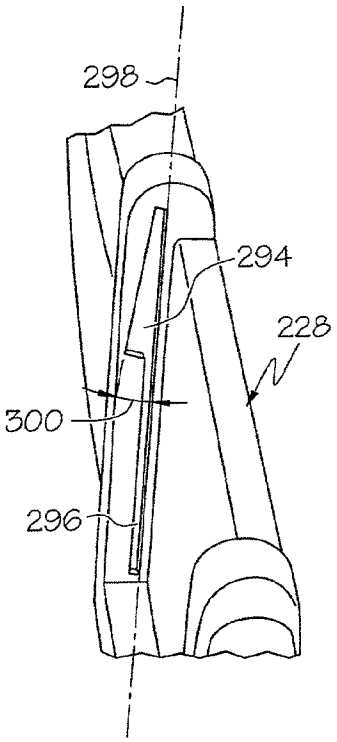
FIG. 14A is a partial perspective view of a docking region of a siderail in accordance with FIGS. 10 and 13.
Figure 14C:
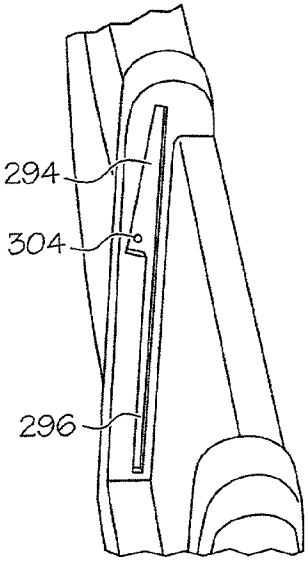
FIG. 14C is a partial perspective view of another embodiment of a docking region in accordance with FIGS. 10 and 13.
Figure 14B:
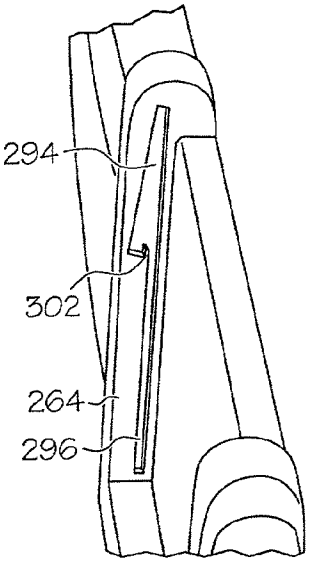
FIG. 14B is a partial perspective view of another embodiment of a docking region in accordance with FIGS. 10 and 13.

Guide tracks 290 includes a first portion 294 and a second portion 296 as shown in FIGS. 14A-14C. First portion 294 includes an angle area defined by angle 301 from vertical axis 298, such that when user module 238 slides upwardly along guide tracks 290, user module 238 assumes the angle 300 as previously described when the guide bars 288 encounter the angled region 294 of the guide tracks 290. In the illustrated embodiment, angle 300 is in the range of about 15-20 degrees from the vertical axis 298, however, in other configurations, angle 300 may be in the range of about 0-90 degrees from the vertical axis.

In the embodiment of FIG. 14B, a step 302 is provided in angled portion 294 of the guide tracks 290 to aid in securing user module 238 in the tilted position. As such, a portion of guide bars 288 abuts the steps 302 when user module 238 is in the use position. Step 302 is molded into side 264 in the illustrated embodiment.

Figure 15:
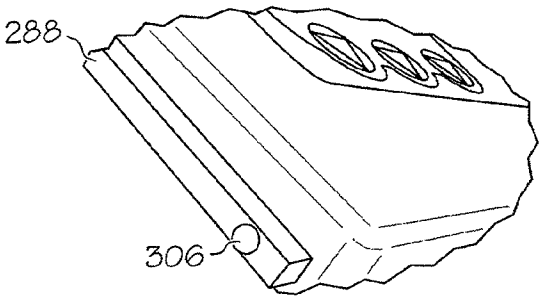
FIG. 15 is a partial perspective view of a side portion of a user module in accordance with FIGS. 10 and 13, including a guide portion.

In the embodiment of FIG. 14C, a detent 304 is provided in angled portion 294 of the guide tracks 290. Detent 304 is configured to receive an ear 306 provided on guide bars 288 as shown in FIG. 15, to aid in stabilizing user module 238 when it is in the use position. Detent 304 is molded into side 264 of the siderail housing 206, and ear 306 is molded as part of guide bars 288, in the illustrated embodiment.

Figure 16:
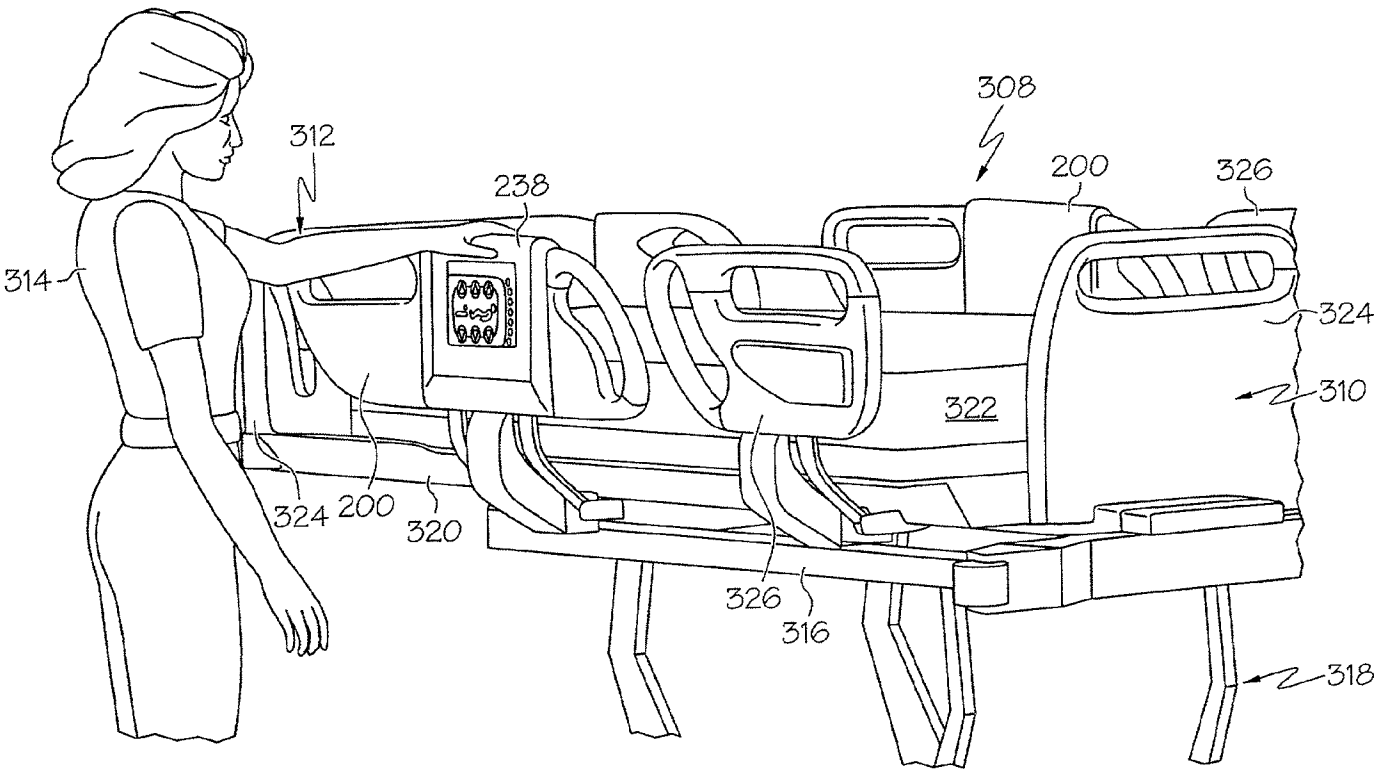
FIG. 16 is a partial perspective view of an exemplary patient support apparatus including a siderail in accordance with FIGS. 10 and 13.
Figure 17:
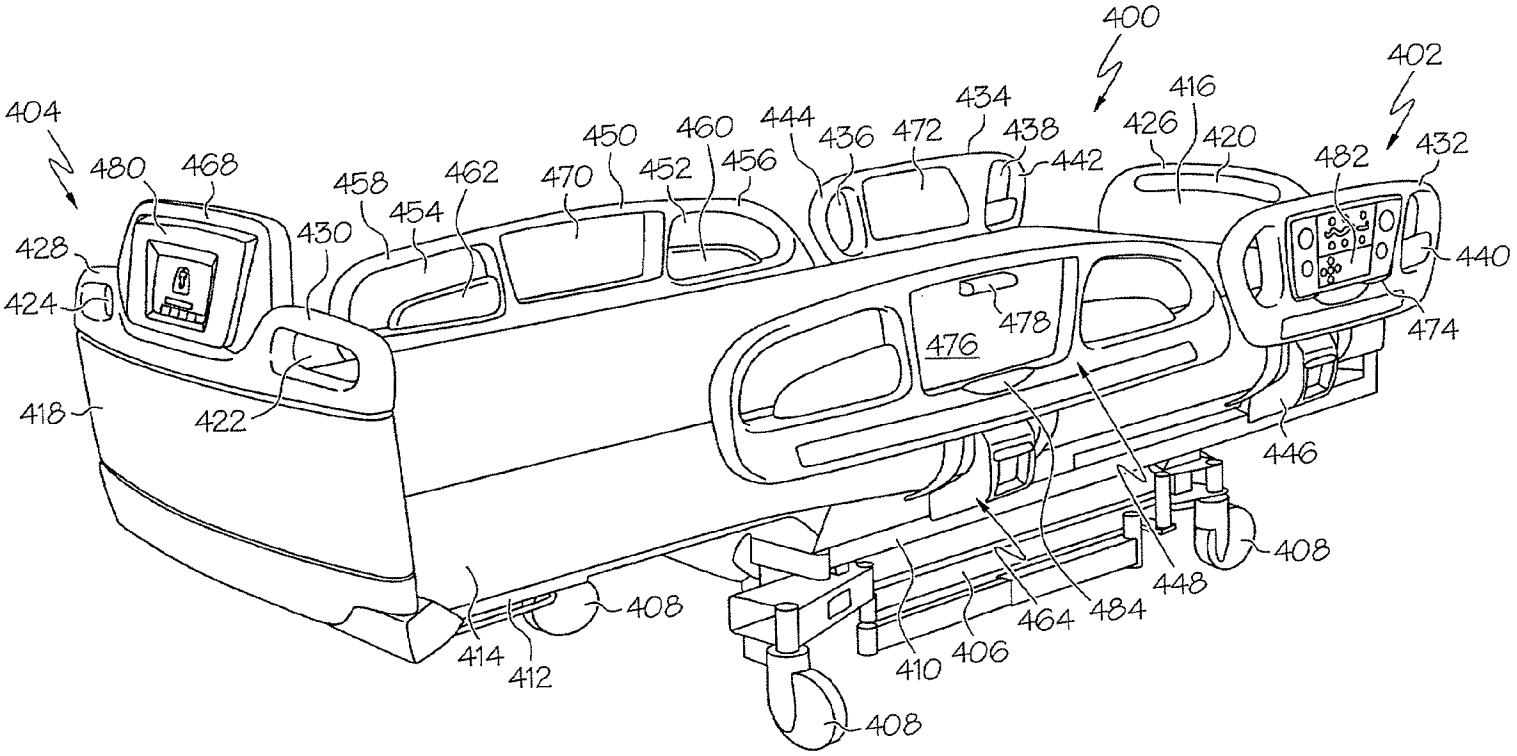
FIG. 17 is a perspective view of an exemplary patient support apparatus, showing barriers including user modules and docking regions.

FIG. 16 illustrates user module 238 in use in connection with an exemplary patient support 308. Patient support 308 includes a head end 310, and a foot end 312. As shown, a user 314 may access user module 238 from a standing position near the patient support 308 and raise user module 238 to its tilted position with one hand.

The exemplary patient support of FIG. 16 includes a bed frame 316, a lift or articulating mechanism 318 (which generally connects to a base, not shown), a deck 320, and a mattress 322 supported by the deck 320. First and second endboards 324 (i.e., a footboard and headboard), as well as siderails 200, are also provided around the perimeter or periphery of the mattress 322. User module 238 is configured to be dockable in a docking region 236 provided on one or more of the siderails 200 and/or endboards 324.

FIGS. 17-21 illustrate embodiments of a patient support apparatus 400 including a first user module 480, a second user module 482, and one or more docking regions 468, 470, 472, 474, 476. Patient support apparatus 400 includes a base 406 supported by casters 408, a frame 410, a deck 412, a mattress 414, and barriers 416, 418, 432, 434, 448, 450. Barriers 416, 418, 432, 434 include a headboard 416, a footboard 418, a pair of siderails 432, 434 located nearer the headboard 416, and a pair of siderails 448, 450 located nearer to the footboard 418 than siderails 432, 434. In the illustrated embodiment, siderails 448, 450 are more or less centrally located near a midpoint of the patient support 400 between headboard 416 and footboard 418.

Headboard 416 includes a handle 426 defined by an aperture 420, and footboard 418 similarly includes handles 428, 430 defined by apertures 422, 424. Headboard 416 and footboard 418 are coupled to corresponding head and foot ends of the patient support 400.

First and second siderails 432, 434 are substantially identical in the illustrated embodiment. Siderails 432, 434 include handles 442, 444 defined by apertures 436, 438 and one or more fillers 440. Siderails 432, 434 are each connected to frame 410 by a connector assembly 446, which is generally operable to move the siderails from a raised position to a lowered position and vice versa. Siderail 432 includes a user module docking region 474 configured to receive a user module 482 and siderail 434 includes a substantially similar docking region 472.

Third and fourth siderails 448, 450 include handles 456, 458 defined by apertures 436, 438. Each of siderails 448, 450 is connected to frame 410 by a connector assembly 464, which is generally operable to raise and lower the siderails 448, 450 between an up or user position and a down or storage position. Siderails 448, 450 also include fillers 460, 462.

In general, each of the barriers 416, 418, 432, 434, 448, 450 may be removably coupled to the patient support 400. One or more of the docking regions 468, 470, 472, 474, 476 may be located on a first or outer side of a barrier facing outwardly away from the mattress and toward a user positioned near the patient support 400, or may be located on a second or inner side of the barrier facing inwardly toward the mattress and toward a user positioned on the mattress. The illustrated embodiment shows a combination of inwardly facing and outwardly facing docking regions. Each docking region may be configured to receive either of the user modules 480, 482, or certain docking regions may be configured to receive one of the user modules and not the other. One or more of the docking regions may include a grip recess 484 to facilitate lifting or removing a user module positioned in the docking region.

Docking regions 470, 472, 474, 476 are generally located within siderails 432, 434, 448, 450 while docking region 468 is provided in or mounted to footboard 418. In the illustrated embodiment, barriers 416, 418, 432, 434, 448, 450 are generally made of molded plastic and docking regions 468, 470, 472, 474, 476 are molded portions of the barriers. Other suitable manufacturing and/or assembly techniques may also be used.

One or more of the docking regions may include a user module coupler 478 to permanently or removably couple a user module to the docking region. In the illustrated embodiment, user modules 480, 482 are generally removably couplable to a docking region 472, 474 by a coupling mechanism such as described herein. However, one or more user modules 480, 482 may be fixed in a docking region and may be upwardly pivotable as described herein.

Each of user modules 480, 482 may include dynamic, i.e. touchscreen, controls or switches or buttons, nondynamic or hardpanel controls or switches or buttons, graphics and/or text, or a combination thereof. In addition, only one form of user module 480 or 482 may be provided, or the features of user modules 480, 482 may be provided on a single module.

Figure 18:
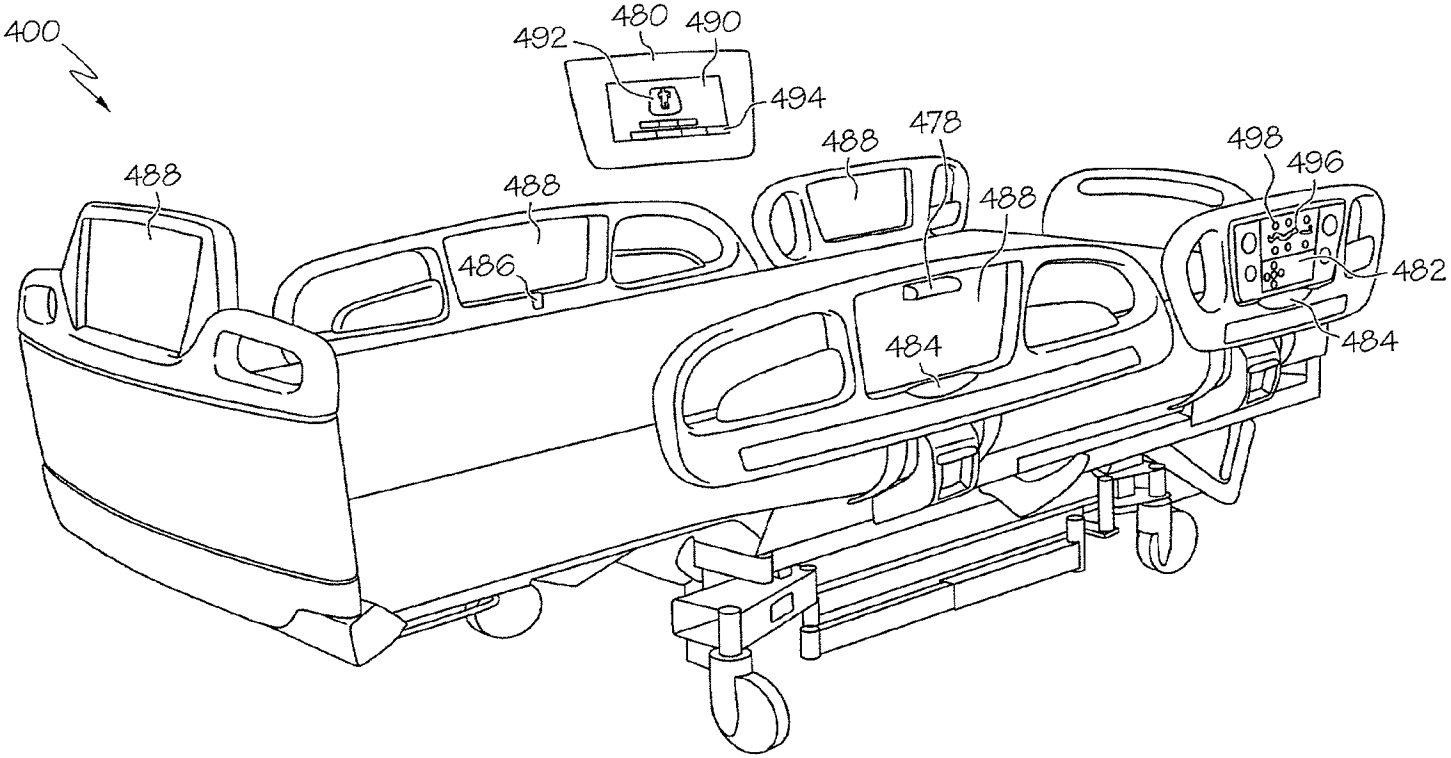
FIG. 18 is another perspective view of an embodiment of a patient support apparatus similar to FIG. 17, showing a removable user module and barriers including docking regions.

FIG. 18 shows an embodiment of a docking region having a recessed portion 488 and a conduit or channel portion 486 configured to route wiring from a user module mountable in the docking region to a controller, power supply or other similar area of the patient support as may be needed. Such connections may also be accomplished by a wireless network.

As shown in FIG. 18, first user module 480 includes a dynamic display 490 including graphics 492 and controls or switches or buttons 494. In the illustrated embodiment, buttons 494 are touchscreen controls. Second user module 482 includes nondynamic or hardpanel graphics 496 and hardpanel controls or switches or buttons 498.

Figure 19:
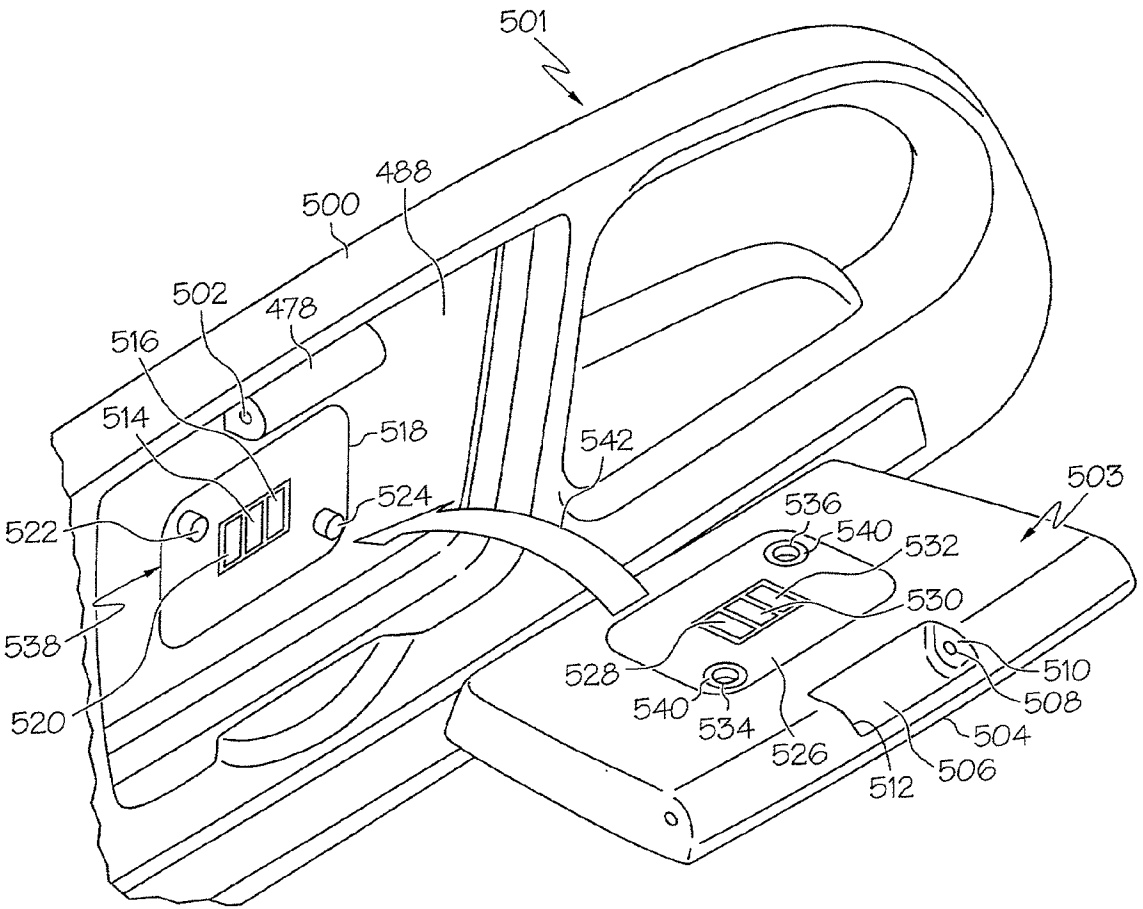
FIG. 19 is a partial perspective view of a user module and docking region of a siderail in accordance with FIGS. 17 and 18.

FIG. 19 shows an embodiment of an electrical mating connector for the "snap in" style user modules described above to connect the electrical circuitry of the user module to that of the patient support. As shown in FIG. 19, the siderail 501 has a top portion 500, a recessed docking region 488 in the siderail similarly to docking regions described elsewhere herein, and a pivot connector 478. A detachable user module 503 is sized to be mounted in or received by the docking region 488 of the siderail. The user module 503 has a top portion 504, which includes a recessed connector area 506, which is shaped to receive the pivot connector 478. In the illustrative embodiment, pivot connector 478 has a concavely shaped face and connector area 506 has a corresponding convexly shaped recess as shown. In addition, pivot connector 478 includes protrusions or ears or spring plungers 502 located on one or both sides of the concave face 478 and configured to mate with corresponding apertures 508 located on either or both sides 510, 512 of the recessed connector area 506 to pivotably couple the user module 503 to the docking region 488. Springs may be coupled to protrusions 502 to facilitate a snap-in/snap-out mounting for the user module 503.

Docking region 488 includes a mating connector region 518 located on the back panel of the recessed area 488 of the siderail 501. Mating connector region 518 includes one or more electrical contacts 514, 516, and 520 for data, power and/or network connections. In the illustrated embodiment, contacts 514, 516 and 520 are leaf contacts. Connector region 518 also includes a locator area 538 configured to mate with the corresponding locator area 526 of user module 503. Locator area 538 includes locating protrusions or pins 522, 524, which are configured to be received by locating pin holes 534, 536 of user module 503 to align electrical contacts 514, 516, 520 of docking region 488 with contacts 528, 530, 532 of user module 503.

User module 503 includes an electrical mating connector 526 located on the rear face of the user module housing 503 and configured to mate with mating connector region 538. Mating connector 526 includes one or more electrical contacts 528, 530, 532 for data, power and/or network connections. In the illustrated embodiment, contacts 528, 530, 532 are surface contacts. Locating pin holes 534, 536 are sized to receive pins 522, 524 as mentioned above. Adjacent to the holes 534, 536 are locator regions 540. Locator regions 540 are recessed, or are made with a different texture than the surface of area 526, or are otherwise configured to facilitate mating of holes 536, 540 with pins 522, 524. In another embodiment, pins 522, 524 are located on user module 503 and the corresponding holes 534, 536 are located in the docking region 488; in other words, the locations of connector region 538 and connector 526 are switched. Electrical connectors 518, 528 enable user module 503 to use a rechargeable power source that can be recharged when module 503 is mounted to a docking region.

Figure 20:
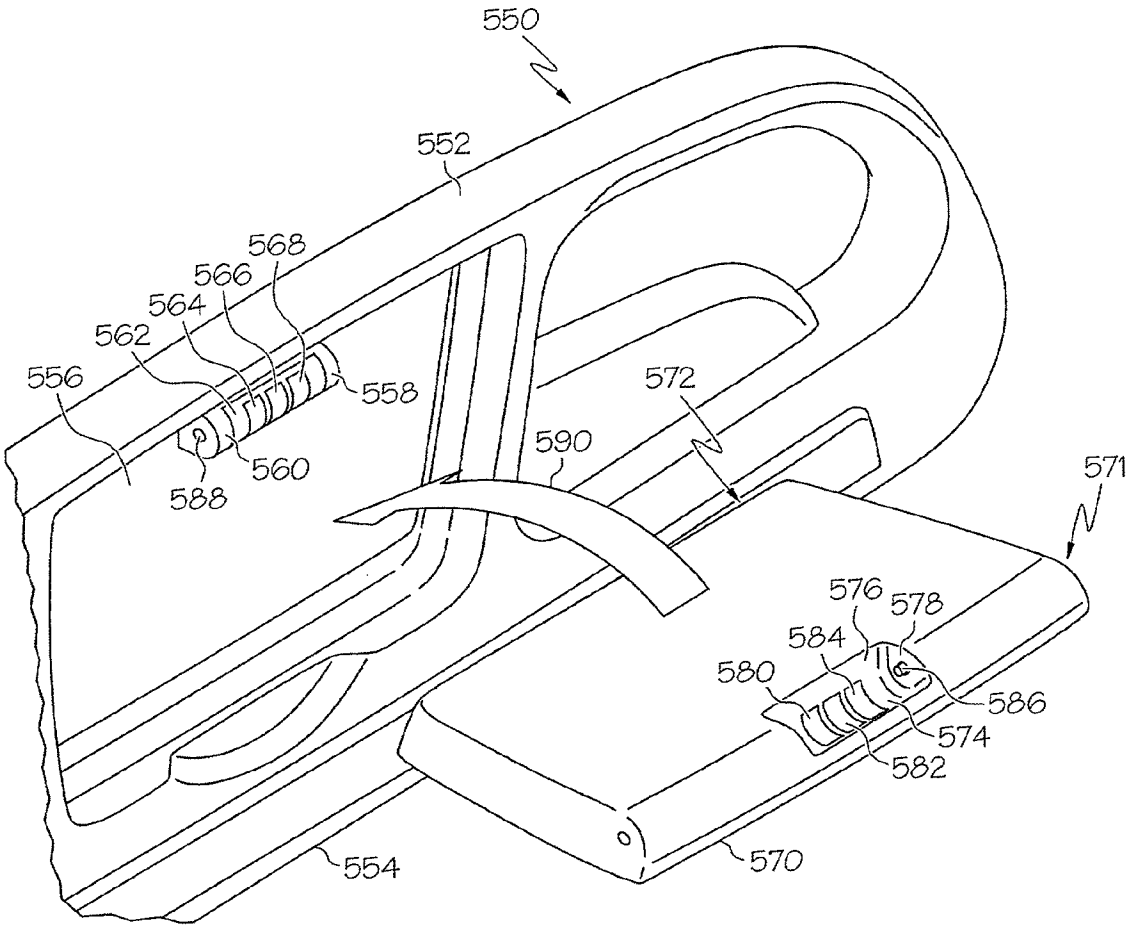
FIG. 20 is a partial perspective view of another embodiment of a user module and docking region of a siderail in accordance with FIGS. 17 and 18.

In the embodiment of FIG. 20, a siderail 550 includes a top portion 552 and a bottom portion 554. Connector 558 is a pivot connector including apertures 588 on either side of concavely shaped face 560 of the pivot connector. Apertures 588 are shaped to receive pivot connector protrusions 586 to pivotably couple a user module 571 to the docking region 556 of the siderail 550. Protrusions 586 may be spring loaded as described above.

In the embodiment of FIG. 20, the electrical contacts are provided as part of the pivot connection as shown. Conductive contacts 564, 566, 568 are concavely shaped following the shape of the surface 560 of the pivot connector 558.

User module 571 has a top portion 570 and a bottom portion 572. Coupling region 574 is, in the illustrated embodiment, located nearer the top portion 570 than the bottom portion 572. Conductive contacts 580, 582, 584 are provided in the recessed area 576 and are convexly shaped corresponding to the shape of the recessed area 576 of the user module 571. In this way, user module 571 is configured to detachably fit within docking region 556 of the siderail 550 as shown by arrow 590.

Figure 21:
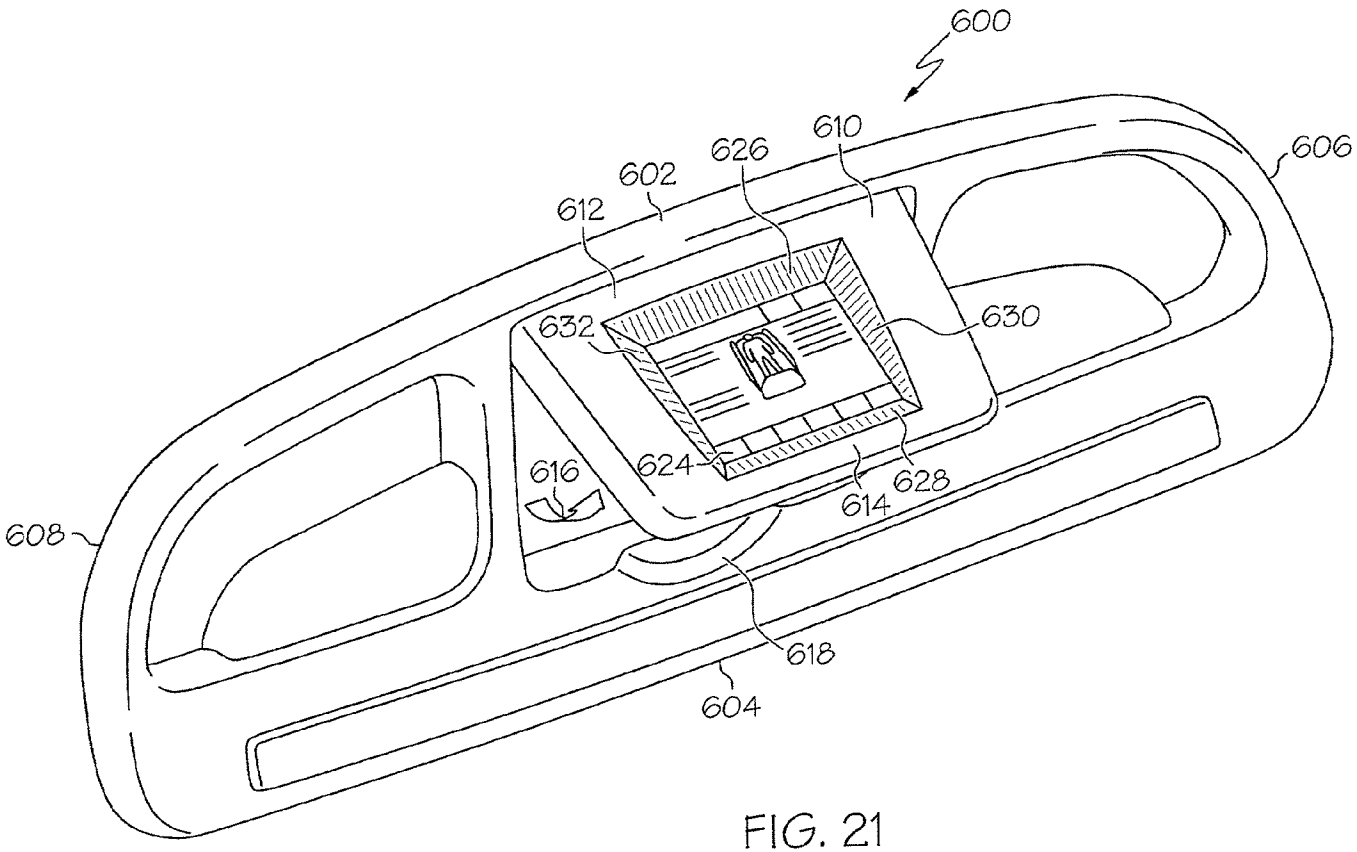
FIG. 21 is a perspective view of another embodiment of a siderail in accordance with FIGS. 17 and 18, showing the user module in a first position.
Figure 22:
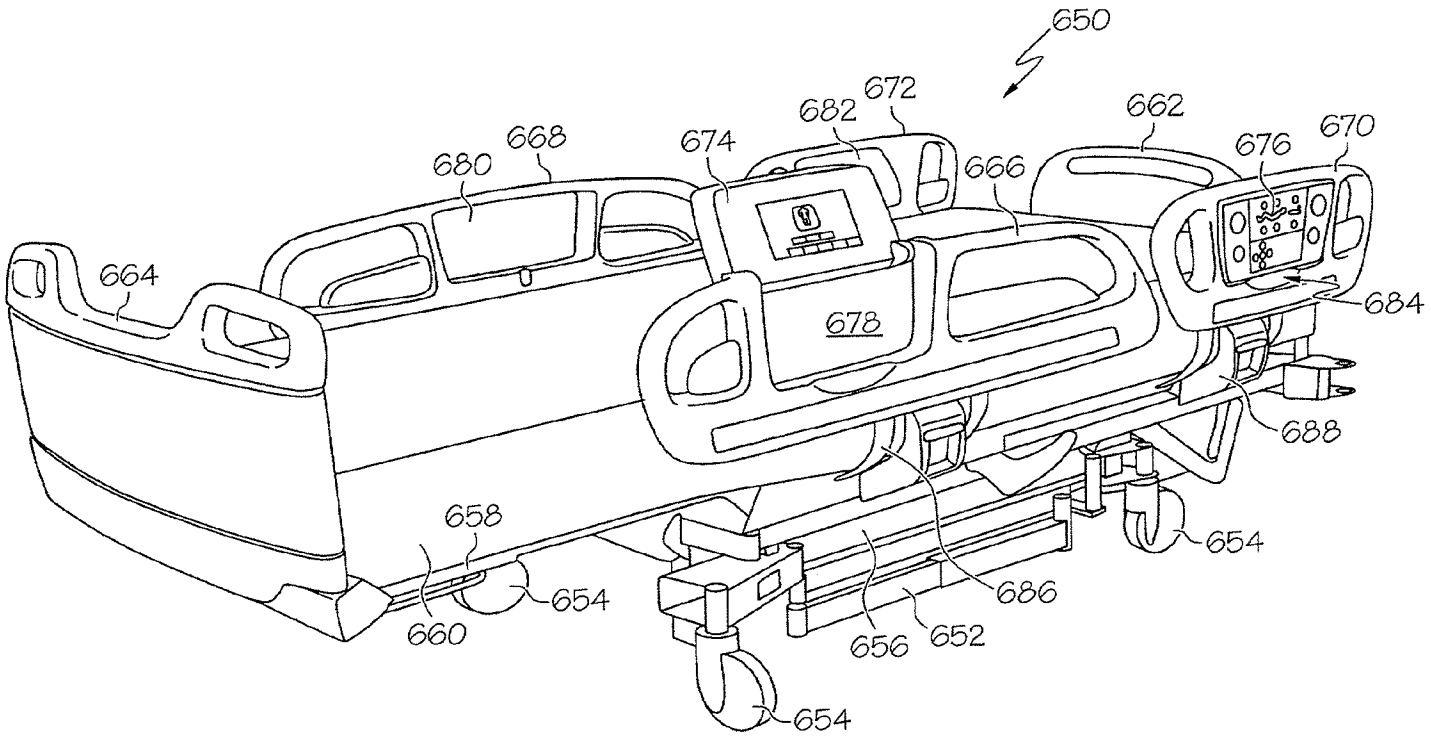
FIG. 22 is a perspective view of another embodiment of an exemplary patient support apparatus including a siderail and a user module shown in a first position.
Figure 23:
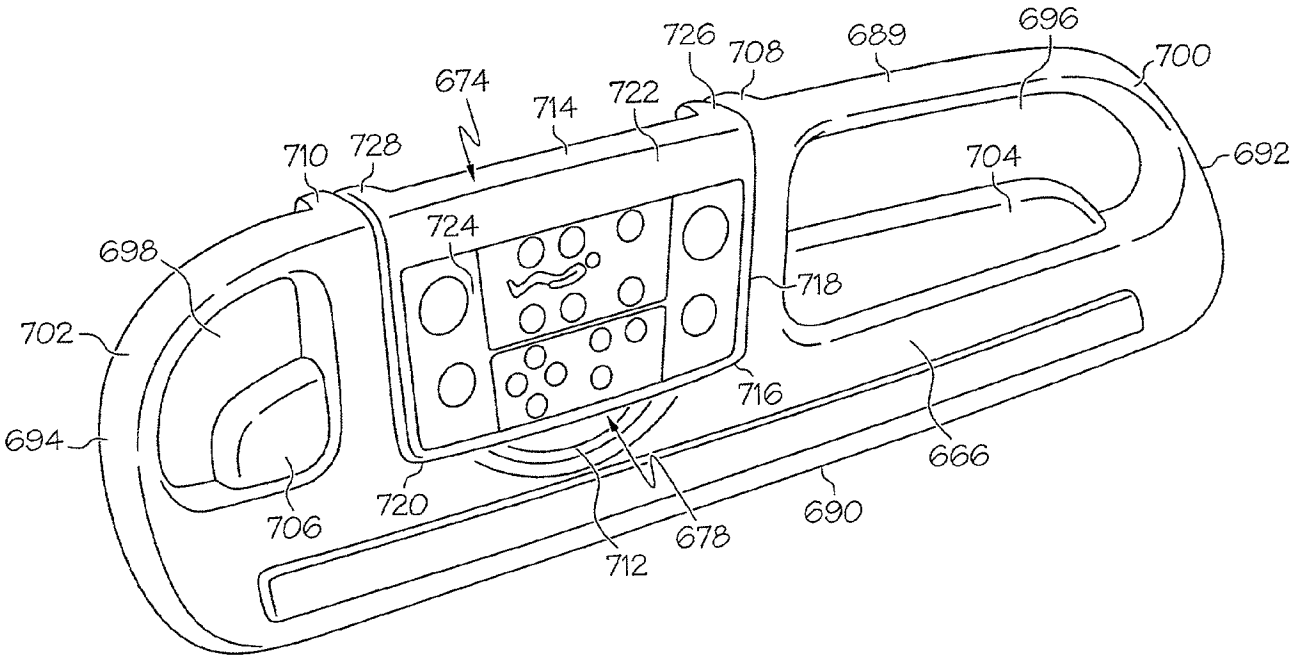
FIG. 23 is a perspective view of a first side of the siderail of FIG. 22, showing the user module in a second position.

FIG. 21 illustrates an embodiment similar to FIG. 20 including a detachable user module 610, wherein user module 610 is pivotable upward away from the rear wall of the docking region as shown by arrow 616. As shown in FIG. 21, the front housing 612, 614 of the user module 610 includes indented sides 624, 626, 628, 630 and touchscreen 624 therefore recessed with respect to front housing 612, 614. User module 610 is pivotable and detachable with respect to a docking region located between first and second ends 606, 608 of siderail 600 and between top and bottom portions 602, 604 of siderail 600. A recessed gripping region 618 is provided to facilitate flip up or detachment of user module 610 from the siderail 600.

FIGS. 22-26, 27A-B, and 28-29 illustrate embodiments of a patient support 650 including one or more docking regions 678, 680, 682, 684 similar to those described above and one or more user modules 674, 676. Patient support 650 includes a base 652 movably supported by casters 654, a frame 656, a deck 658, a mattress 660 supported by the deck 568, and one or more barriers such as a headboard 662, a footboard 664, and siderails 666, 668, 670 and 672. Siderails 666, 668, 670, 672 are connected to patient support 650 by connector assemblies 686, 688 in a similar fashion as described above. In the illustrated embodiment, one or more of siderails 670, 672 include a snap-in user module 676 as described above. Siderail 666 includes a pivotable "flip-over" user module 674 and one or more of the other siderails or endboards of the patient support may also be configured to mount such a user module thereto as well.

Siderail 666 includes a top portion 689, a bottom portion 690 and first and second ends 692, 694. A handle 700 defined by aperture 696 is located proximate the first end 692 and likewise, a handle 702 defined by aperture 698 is located proximate the second end 694. Fillers 704, 706 are provided in apertures 696, 698.

Coupling regions 708, 710 of siderail 650 are provided on either side of docking region 678 for pivotably coupling the user module 674 to the siderail 650. Recessed area 712 is provided under the docking region 678 to facilitate lifting and rotation of the user module 674 with respect to the siderail 650.

User module 674 includes a top portion 714, a bottom portion 716, first and second sides 718, 720 and a front side 722. A first user interface 724 is located on the front side 722 of the user module 674. First user interface 724 includes graphics, text and/or controls, buttons or switches as described herein. In the illustrated embodiment, first user interface 724 includes hardpanel controls and graphics.

Figure 24:
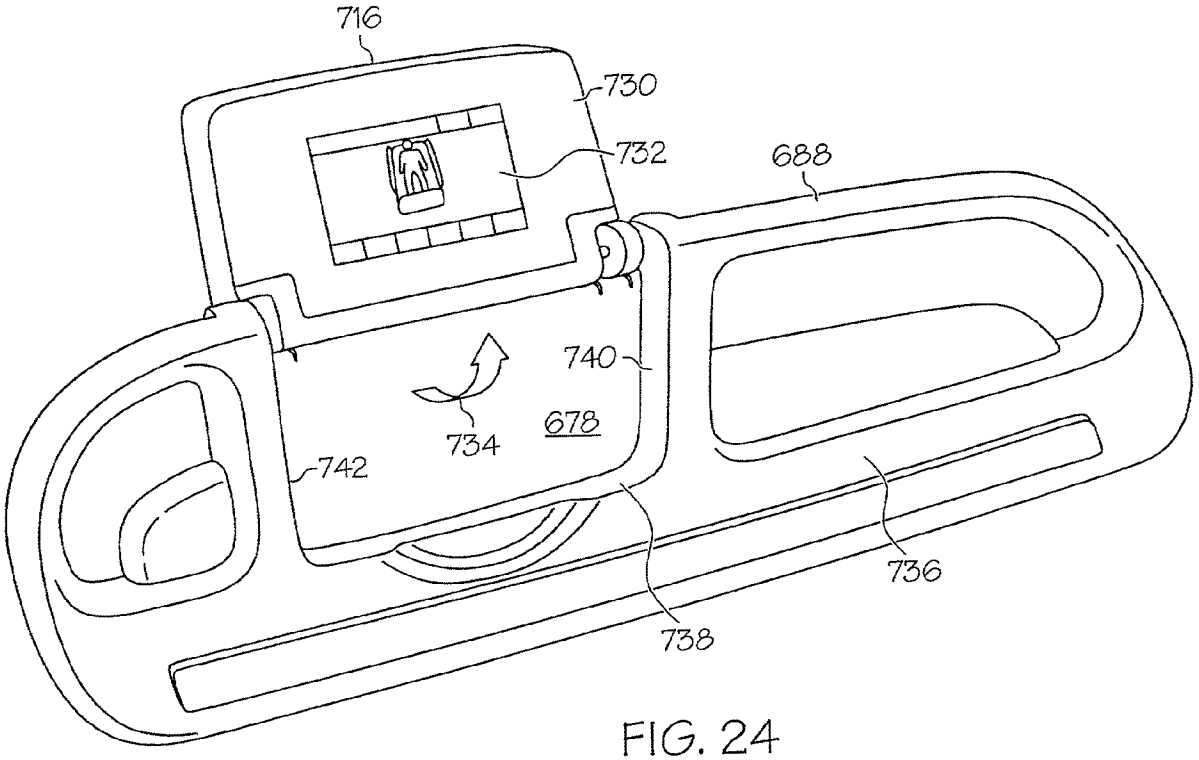
FIG. 24 is another perspective view of the first side of the siderail of FIG. 23 showing the user module in the first position.

User module 674 has a second side 730 which is revealed when user module 674 is rotated upwardly in the direction of arrow 734, as shown in FIG. 24. Second side 730 includes a second user interface 732. Second user interface 730 includes graphics, text and/or controls, buttons or switches as described herein. In the illustrated embodiment, second user interface 730 includes touchscreen controls and graphics.

Docking region 678 is a recessed area in siderail 666 defined by indented sides 738, 740, 742 and is sized to receive the user module 674 in the recessed area.

Figure 25:
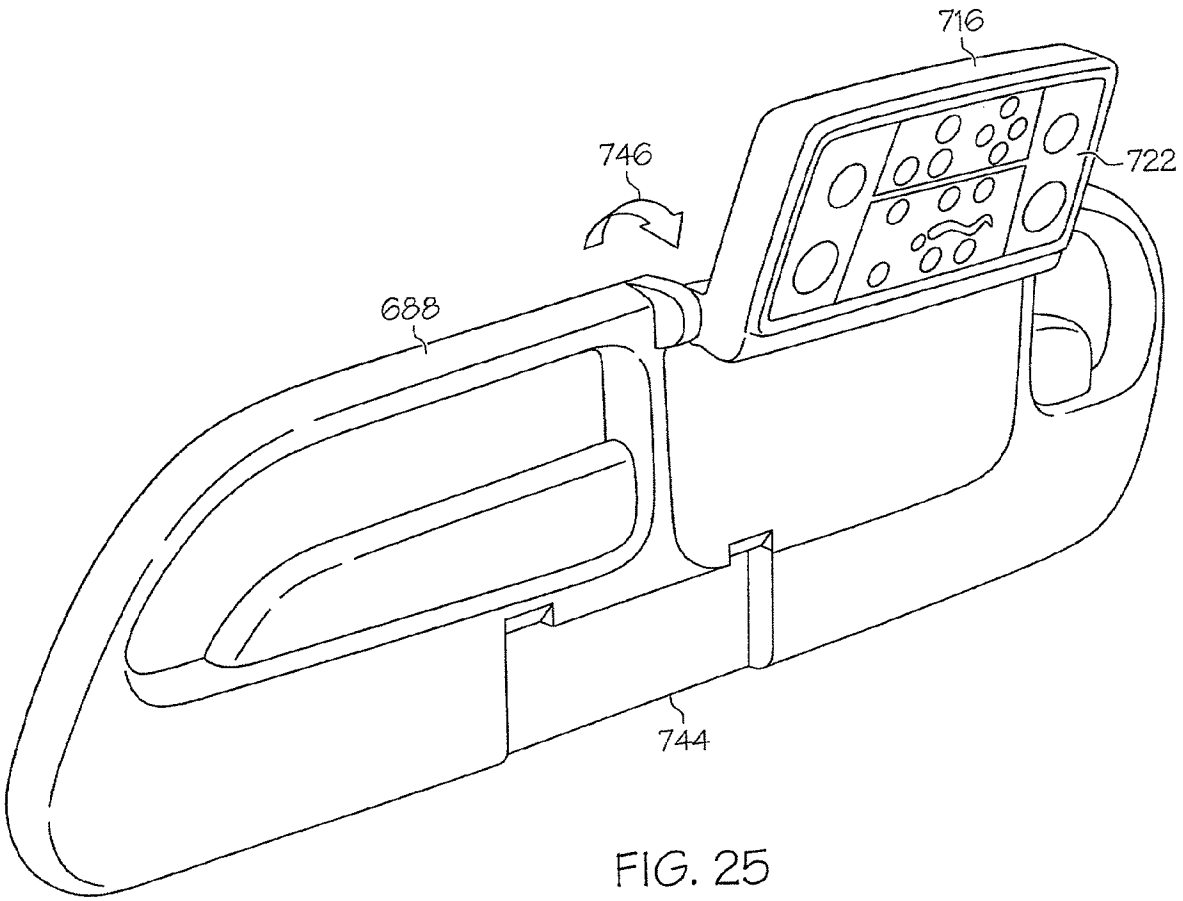
FIG. 25 is a perspective view of a second side of the siderail of FIG. 22, showing the user module in the first position.

FIG. 24 shows a first side 736 of siderail 688 while FIG. 25 shows a second or opposite side 744 of siderail 688 with the user module 647 rotated upwardly in the direction of arrow 746. In the illustrated embodiment, first side 736 is configured to face outwardly away from the mattress to be viewable by a user positioned next to the patient support. Controls located on front side 722 are disabled or otherwise secured so that they are imperable to a patient positioned on the mattress when the user module is rotated upwardly to the position shown by FIGS. 24-25.

Figure 26:
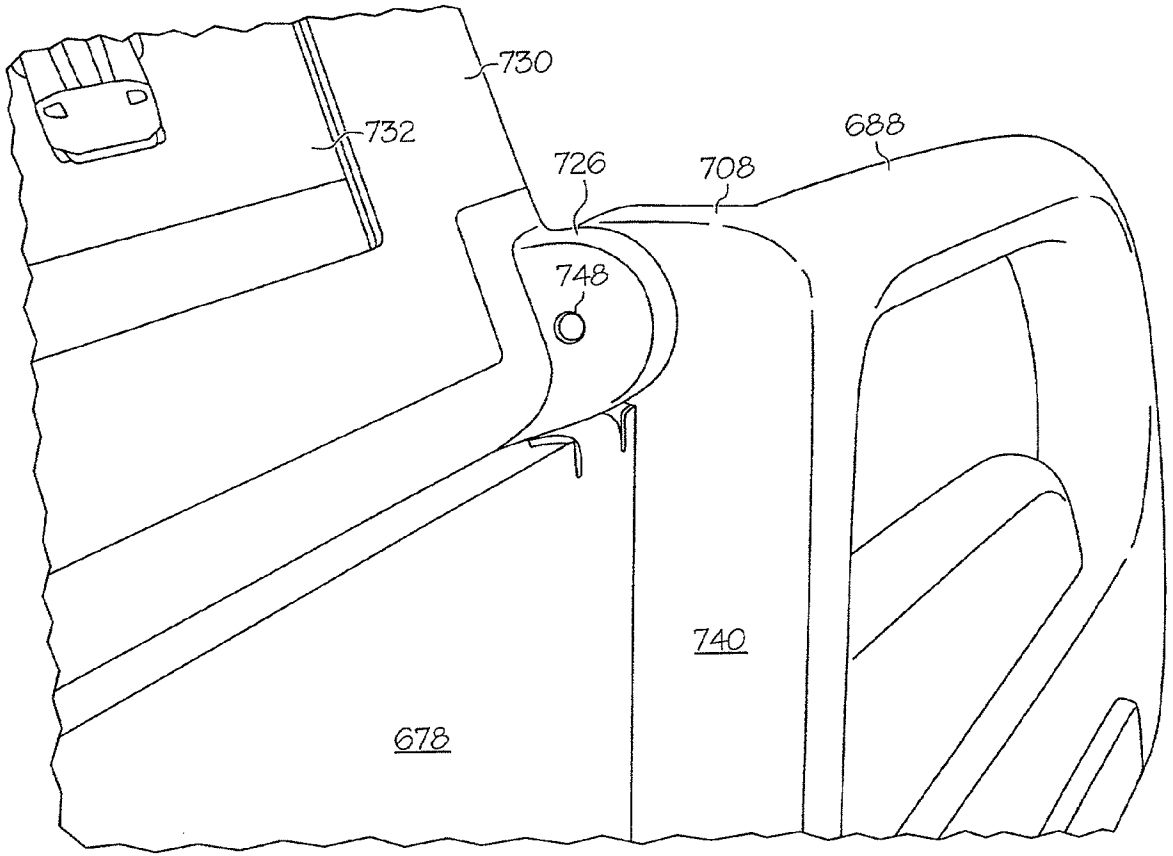
FIG. 26 is a partial perspective view of the siderail of FIG. 22 showing a pivot coupler.
Figure 27A:
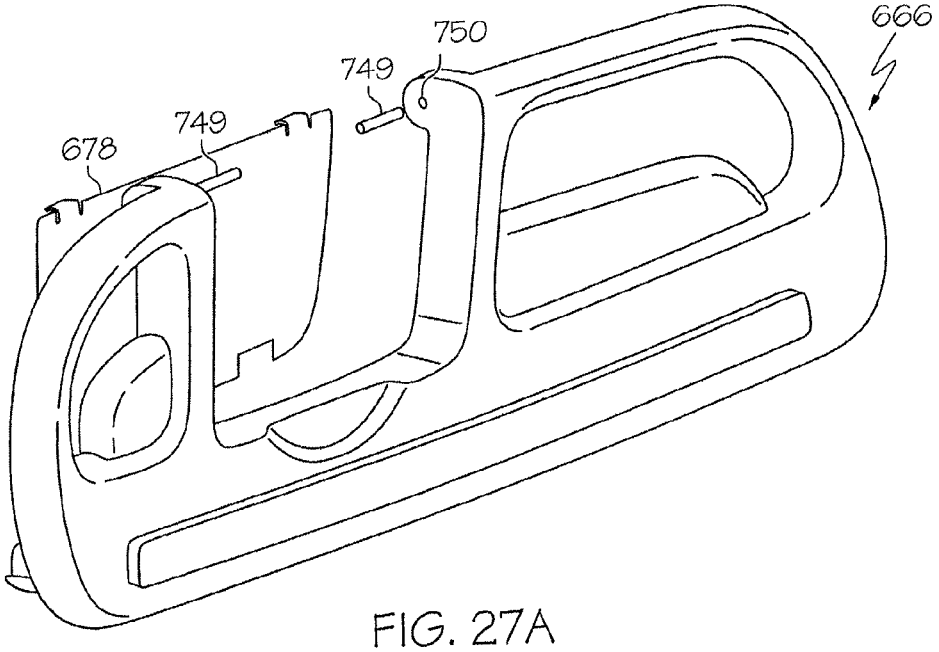
FIG. 27A is a simplified exploded view of the first side of the siderail of FIG. 22.
Figure 28:
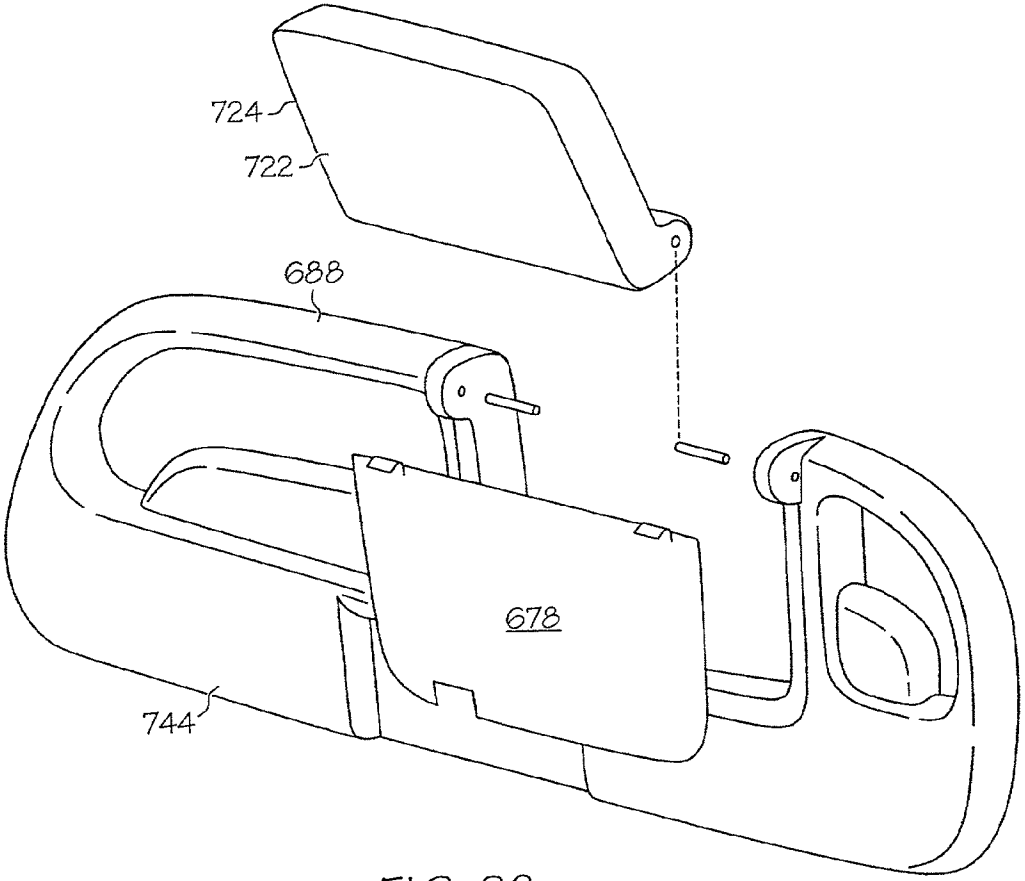
FIG. 28 is a simplified exploded view showing the second side of the siderail and user module of FIG. 22.

FIG. 26 shows in greater detail the coupling region 726 of the user module 674. While any suitable conventional pivot coupling mechanism may be used, in the illustrated embodiment coupling region 726 extends outwardly away from the second side 730 of the user module. Siderail 688 includes a corresponding coupling region 708 to which coupling region 726 is pivotably coupled. Coupling region 708 extends from side 740 and in back of back panel 678 as shown. Coupling region 726 includes an aperture 748 and likewise coupling region 708 includes an aperture 750. Pivot coupler 749 is inserted into apertures 748, 750. Such pivot coupling is provided on either side of the user module as indicated by FIGS. 27A and 28. Pivoting coupler assembly 748, 749, 750 may include a friction hinge on at least one side of the user module 730 to reduce the speed of rotation and therefore the risk of danger to the user module when rotated downwardly to the recess 678.

Figure 27B:
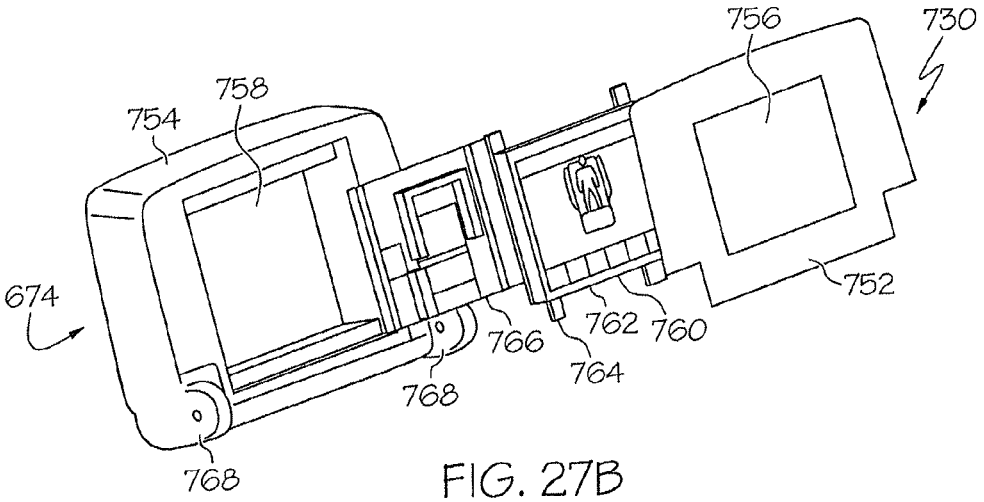
FIG. 27B is a simplified exploded view of a first side of the user module of FIG. 22.

A simplified exploded view of the assembly of user module 674 is shown in FIG. 27B, from the perspective of a person viewing the second side 730 when user model 674 is in the upwardly rotated position of FIG. 24. User module 674 includes a first or front housing portion 752 and a second or back housing position 754. Sandwiched front housing 752 are dynamic display components including touchscreen 760, liquid crystal display (LCD) or similar suitable display 762, gaskets 764 and control board 766. Front housing 752 includes aperture 756 thought which touchscreen 760 is visible to a user. In this manner, all of the required user interface components are housed with the user module 674.

Figure 29:
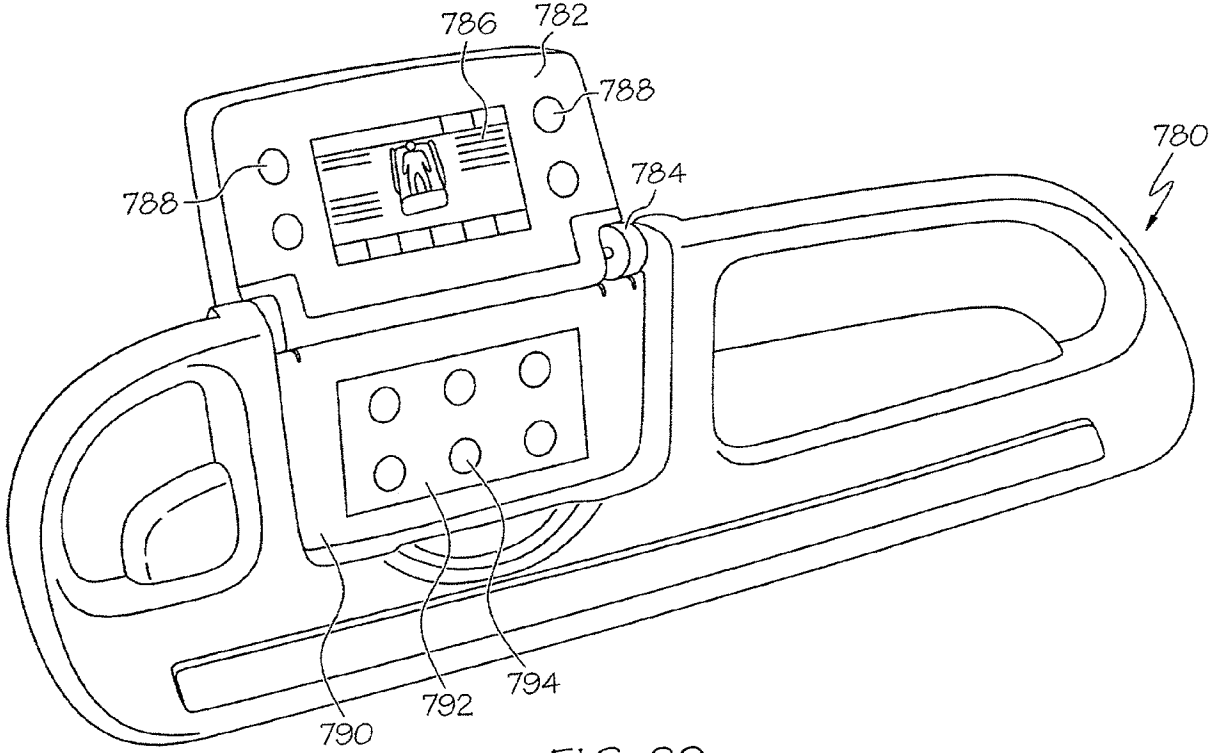
FIG. 29 is a perspective view of another embodiment of a siderail similar to FIG. 22 including at least one user module.

FIG. 29 illustrates another embodiment of a siderail 780 similar to the previously described embodiment, wherein a first user module 782 is pivotably coupled to siderail 780 by a pivot coupler 784. First user module 782 includes a first user interface 786 and one or more buttons or controls or switches 788. In the illustrated embodiment, first user interface 786 is a touchscreen and includes text, graphics and/or touchscreen controls or switches or buttons as described above. In FIG. 29, the recessed docking region of siderail 780 includes a second user module 790. Second user module 790 includes a second user interface 792 built into the siderail 780. Second user interface includes one or more user controls or switches or buttons but may text, touchscreen and/or graphics as well. In embodiments including user modules pivotably coupled to a siderail or other barrier, electrical components of the user module may be connected to a power supply and/or main controller of a patient support by routing the connecting wiring through the pivot coupling regions of the user module and docking regions and down through the interior region of the siderail to a destination within the dimensions of the bed frame or base of the patient support.

Figure 30:
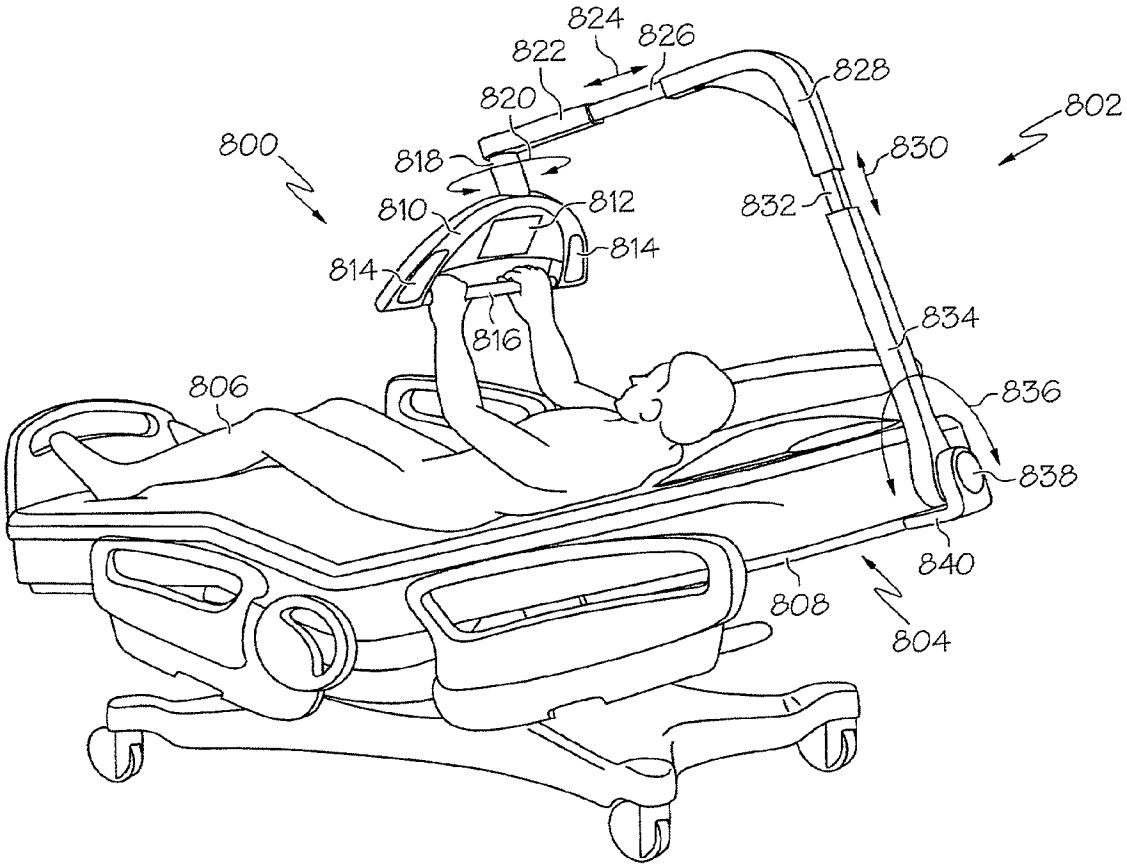
FIG. 30 is a perspective view of an embodiment of a patient support apparatus including a user module and an arm assembly.

FIGS. 30-31 and 32A-32F illustrate embodiments of a user module for a patient support and an arm assembly. FIG. 30 shows a user module 800 coupled to a patient support 804 by an arm assembly 802 and a patient 806 positioned on the patient support 804.

User module 800 includes a housing 810, a display 812, and one or more user areas 814 which include graphics, text, and/or controls, buttons or switches as described above. In the illustrated embodiment, display 812 is a touchscreen and includes touchscreen controls, switches or buttons. A pull up bar or handle 816 is also provided with user module 800, which can be used to facilitate repositioning of a patient 806. In the illustrated embodiment, bar 816 is provided below display 812, such that there is an aperture or open area between display 812 and bar 816 as shown.

User module 800 is pivotably coupled to arm assembly 802 by a pivot coupler 818 such that user module 800 is up to 360 degrees rotatable with respect to the arm assembly 802 as shown by arrow 820. Pivot coupler 818 is coupled to a first arm portion 822.

First arm portion 822, first extender 826 and the substantially horizontal section of u-shaped arm portion 828 of arm assembly 802 are generally configured to extend over the top portion of the patient support 804 and above the patient 806. Extender 826 is slidably coupled to u-shaped arm portion 828 to extend or retract the length of the overhead portion of the arm assembly 802 as shown by arrows 824. A substantially vertical section of u-shaped portion 828 is coupled to an extender 832. Extender 832 is slidably coupled to arm portion 834 to extend or retract the length of the substantially vertical portion of arm assembly 802 as shown by arrows 830. Arm portion 834 is pivotably coupled to bracket 840 by a pivot coupler 838. Pivot coupler 838 is illustratively a tension screw that may be tightened when rotated clockwise and loosened when rotated counterclockwise; such that movement of arm 834 is restricted when coupler 838 is tightened and movement of arm 834 in the directions of arrow 836 is permitted when coupler 838 is loosened. Bracket 840 is coupled to and supported by deck 808 of the patient support. FIG. 30 shows arm assembly 802 coupled to the head section of the patient support 804. In other embodiments, arm assembly 802 may be coupled to either side or to the foot end of the deck 808.

Figure 31:
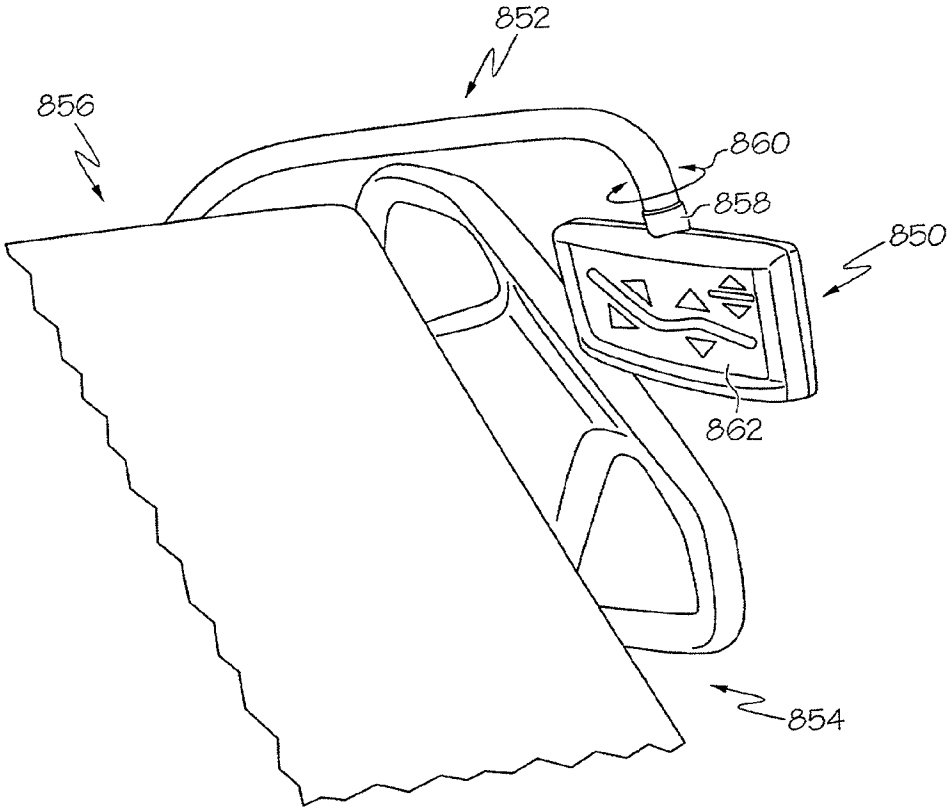
FIG. 31 is a partial perspective view of another embodiment of a patient support apparatus including a user module and an arm assembly.

Another embodiment of a user module 850 is shown in FIG. 31. User module 850 includes a user interface 862, which may include text, graphics, and/or controls as described above. A pivot coupler 858 couples user module 850 to a bendable, movable arm 852. Arm 852 is pivotably coupled to foot end 856 of patient support 854. User module 850 is rotatable with respect to arm 852 up to 360 degrees as shown by arrows 860. Arm 852 is of a conventional gooseneck style or similar flexible structure. In this way, user module 850 may be repositioned to be accessible to a user located near the foot end 856 of the patient support 854, or to a user located on either side of the patient support 854, without detaching the user module 850 from the patient support.

FIGS. 32A-32F illustrate another embodiment of a user module 900 for a patient support 904. User module 900 is coupled to an endboard 902 of the patient support 904 by an arm assembly 906. In the illustrated embodiment, endboard 902 is a footboard coupled to the foot section of the patient support 904.

User module 900 includes a top portion 922, a bottom portion 924, a first side 926, a second side 928, a front side including user interface 930 and a rear side 960. Generally within the boundaries of top and bottom portions 922, 924 and first and second sides 926, 928, a user interface 930 is provided. In the illustrated embodiment, user interface 930 is a touchscreen but it may include any of the features of user modules described elsewhere herein.

Footboard 902 has a top portion 910, a bottom portion 912, a first side 914 and a second side 916. A recessed area 936 is sized to receive user module 900 substantially within the dimensions of the footboard 902 when the user module 900 is in a first position shown in FIG. 32A. Such recessed area includes a back wall 936 and indented sides 938, 940, 942. A recessed grip or lift area 918 is proximate the recessed area to facilitate lifting or gripping of user module 900. A coupling region 944 is provided near the top edge 910 of the footboard 902.

User module 900 is coupled to footboard 902 by an arm assembly 906. Arm assembly 906 includes a first arm portion 946 and a second arm portion 948.

Figure 32A:
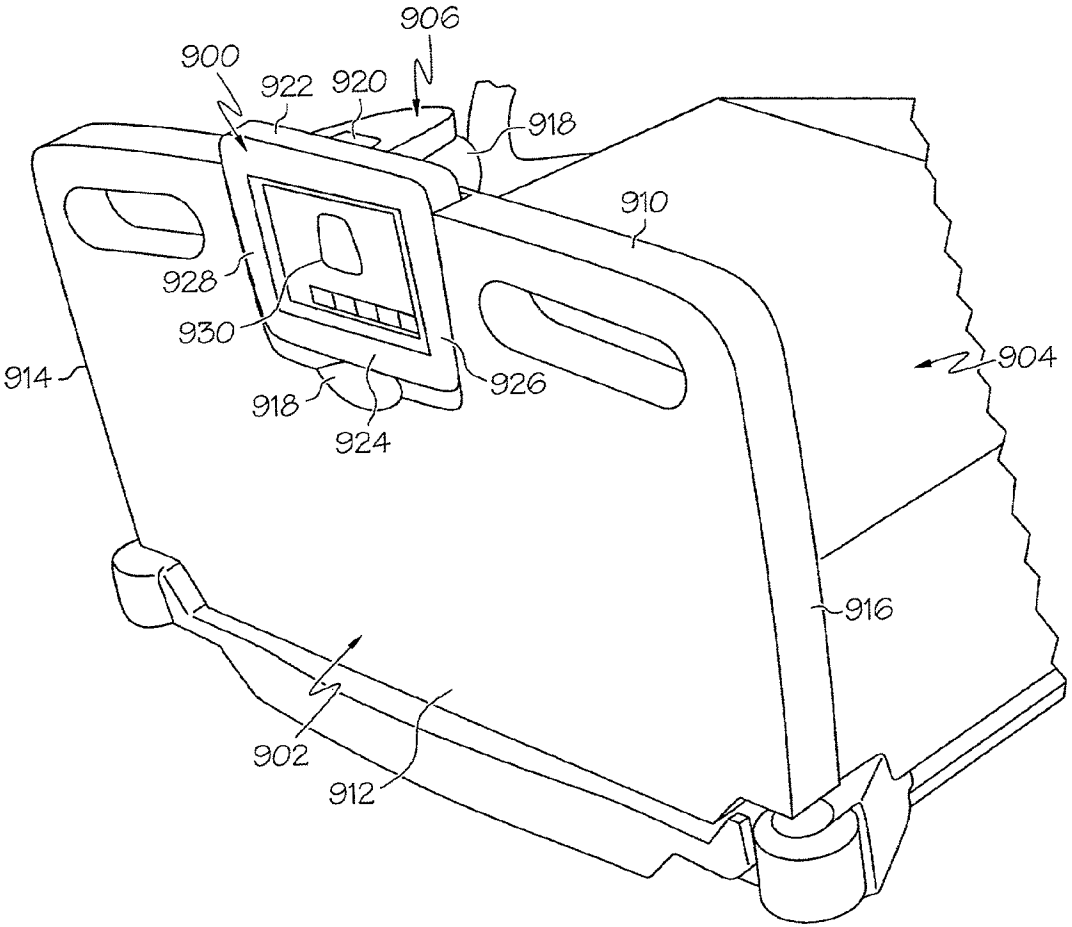
FIGS. 32A-32F are partial perspective views of another embodiment of a patient support apparatus including a user module and an arm assembly.
Figure 32B:
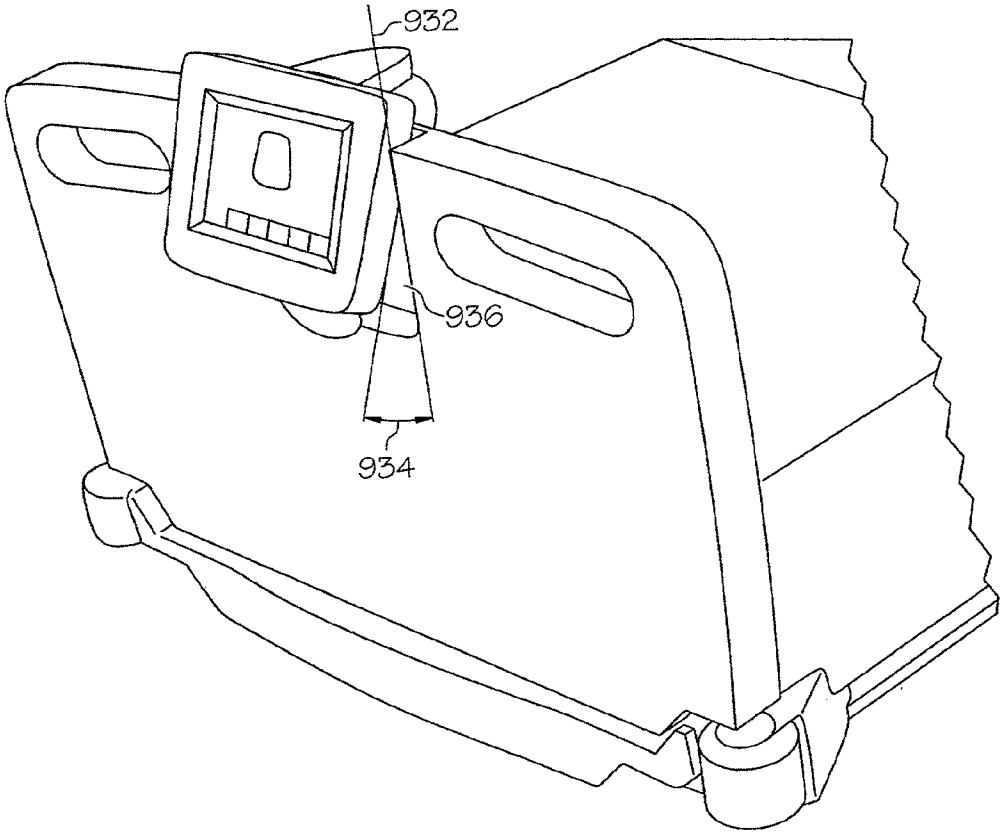
Figure 32C:
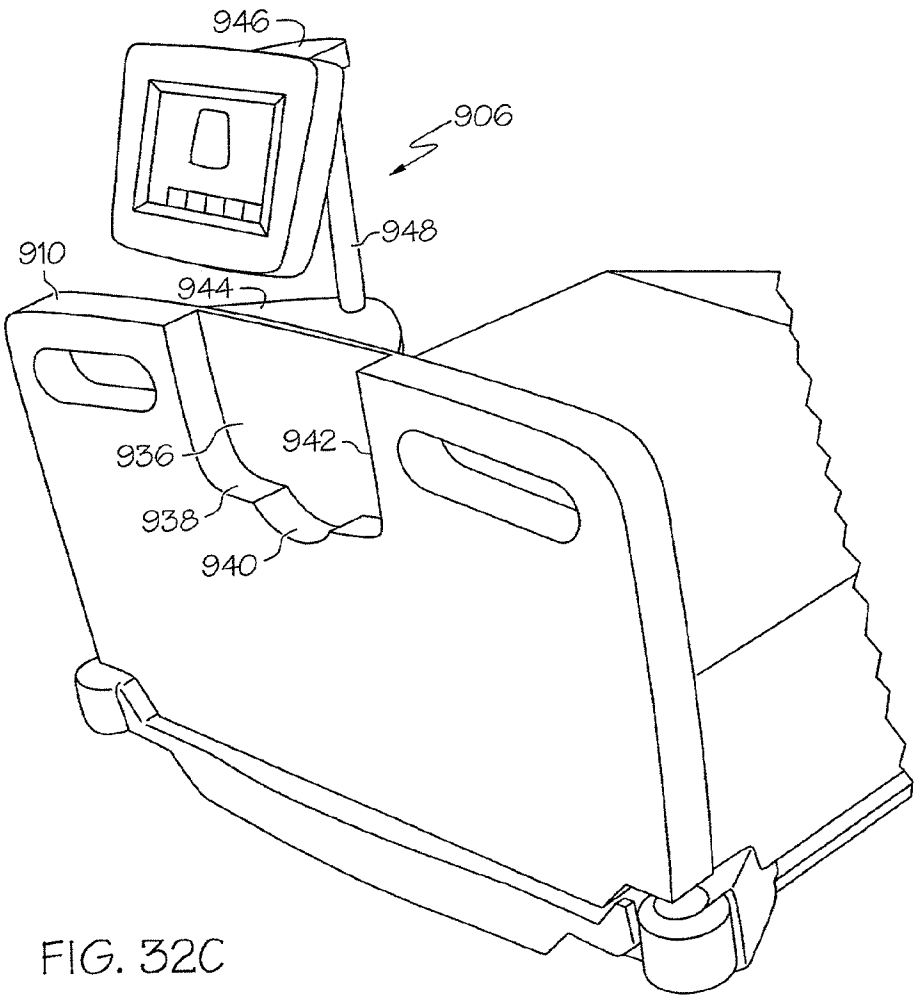

User module 900 is pivotably coupled to first arm portion 946 by a pivot coupler 920 coupled to the rear side 960 so that user module 900 is upwardly tiltable to an angle 934 from a vertical axis 932 of the footboard 902 as shown in FIG. 32B. Pivot coupler 920 rotates around a pin 964 inserted through a coupling region 962 of arm portion 946.

Figure 32D:
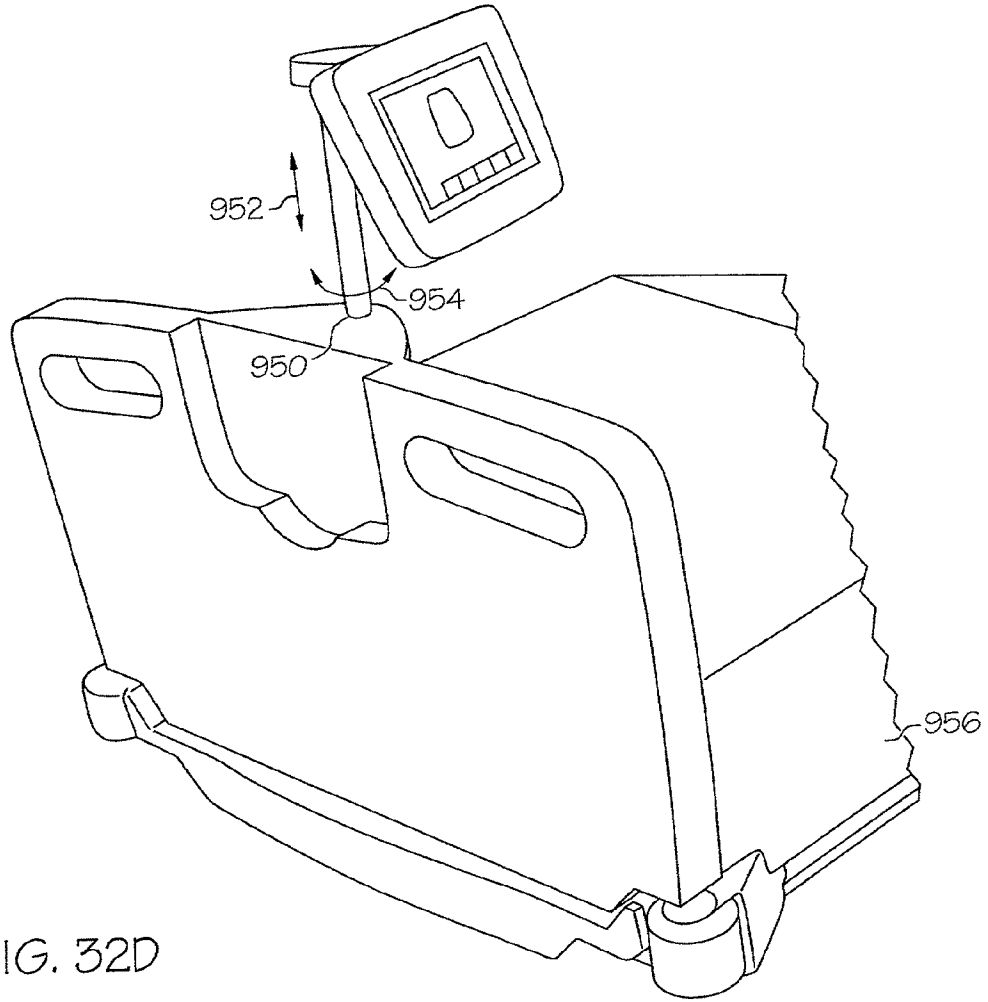
Figure 32E:
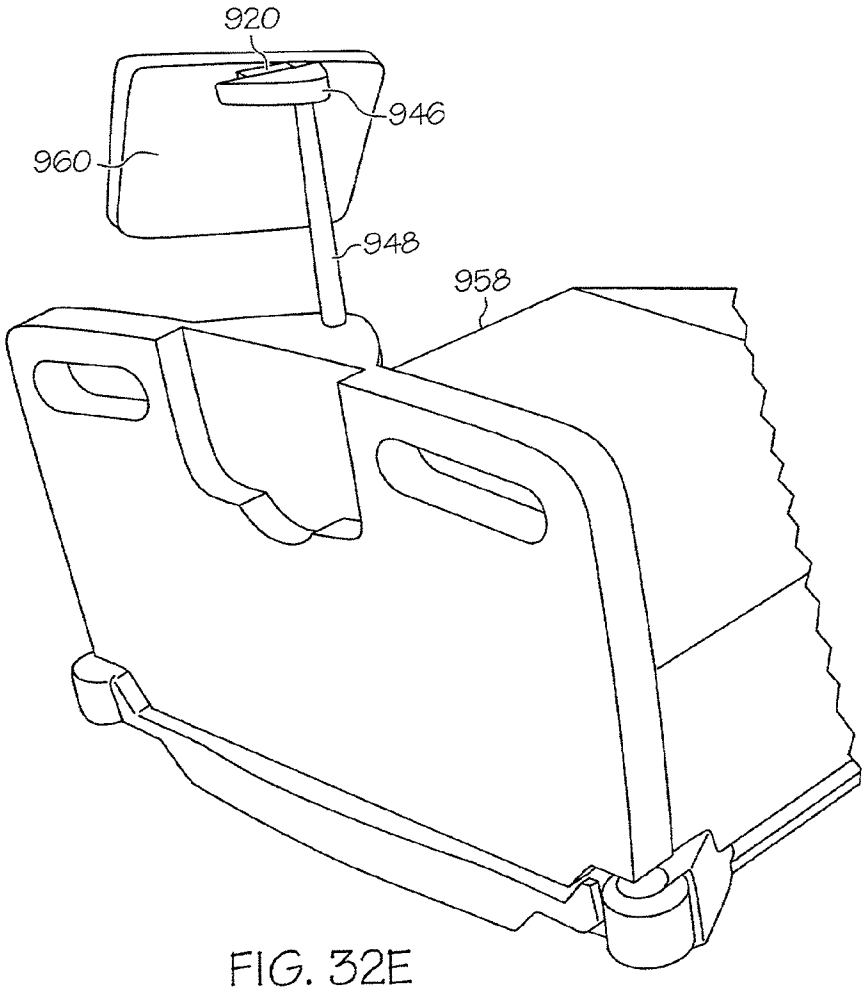
Figure 32F:
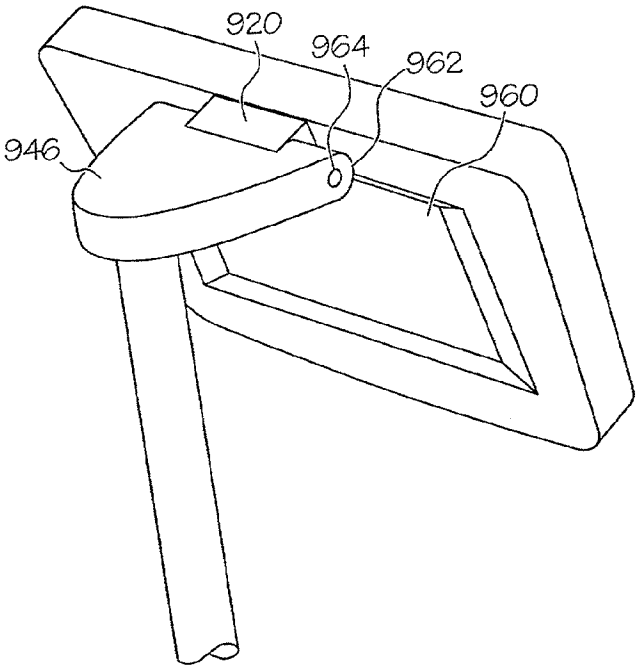

Second arm portion 948 is slidably coupled to coupling region 944 of the endboard 902. Coupling region 944 includes a channel 950 which is configured to slidably receive arm portion 948 such that arm portion 948 is upwardly and downwardly movable as shown by arrows 952. Coupling region 944 is also configured to allow rotation of arm portion 948 as shown by arrow 954 of FIG. 32D. In this way, user interface 930 may be vertically adjusted and rotated to be viewable by a person located near the endboard 902 or on either side 956, 958 of the patient support 904 as shown by FIGS. 32D and 32E.

In general, structural housing components of siderails and user modules disclosed herein are made of molded plastic, stainless steel or other similar suitable material, and conventional techniques for hinging, coupling, pivoting or sliding mechanisms, and molding, may be used in any of the illustrated embodiments.

Viewing angles of user modules described herein are generally operable without regard to the positioning of the siderail, i.e., whether the siderail is in a raised or lowered position. Features of siderails described herein are generally applicable to corresponding siderails located on opposite sides of a patient support, or to other siderails or barriers that may be used in connection with a patient support.

Features of the various user modules described herein, for example, touchscreens, graphics, text, hardpanel controls, and the like, are generally interchangeable such that a user module described as having touchscreen controls may alternatively or in addition include hardpanel controls, and vice versa.

The present invention has been described in detail with reference to certain illustrative embodiments. However, the foregoing description is not intended to limit the scope of protection of the present invention to the precise terms and embodiments set forth herein.

What is claimed is:

1. A patient support apparatus comprising:

a footboard having a main body including an upwardly facing top edge and a recess that is open at the top edge; and a user module coupled to the main body by a coupler that is spaced apart from the recess, a first portion of the user module being received in the recess, and a second portion of the user module extending upwardly out of the recess beyond the top edge of the footboard, the user module having a touchscreen that displays first user inputs that are selectable to control one or more functions of the patient support apparatus.

2. The patient support apparatus of claim 1, wherein a bottom surface of the user module is exposed within the recess.

3. The patient support apparatus of claim 1, wherein the touchscreen is inclined at an angle relative to the main body of the footboard.

4. The patient support apparatus of claim 1, wherein the user module is detachable from the footboard.

5. The patient support apparatus of claim 1, wherein the one or more functions controlled by the first user inputs of the user module comprise a scale function in which a weight of a patient supported by the patient support apparatus is measured.

6. The patient support apparatus of claim 1, wherein the one or more functions controlled by the first user inputs of the user module comprise moving one section of the patient support apparatus relative to another section of the patient support apparatus.

7. The patient support apparatus of claim 1, wherein the one or more functions controlled by the first user inputs of the user module comprise adjusting the configuration of a bed frame of the patient support apparatus.

8. The patient support apparatus of claim 1, wherein the one or more functions controlled by the first user inputs of the user module comprise adjusting the configuration of a mattress of the patient support apparatus.

9. The patient support apparatus of claim 1, wherein the one or more functions controlled by the first user inputs of the user module comprise activating or deactivating a therapy of the patient support apparatus.

10. The patient support apparatus of claim 1, wherein the one or more functions controlled by the first user inputs of the user module comprise managing one or more alarms of the patient support apparatus.

11. The patient support apparatus of claim 1, further comprising a bed frame to which the footboard is coupled and a siderail coupled to the bed frame, the siderail including at least one electrical contact for electrically coupling to an external device when the external device is supported by the siderail.

12. The patient support apparatus of claim 11, wherein the siderail includes a recess in which the external device is received when supported by the siderail.

13. The patient support apparatus of claim 1, further comprising a bed frame to which the footboard is coupled, a siderail coupled to the bed frame, and a second user module coupled to the siderail, the second user module having second user inputs that are selectable to control the one or more functions of the patient support apparatus.

14. The patient support apparatus of claim 13, wherein the one or more functions controlled by the second user inputs of the second user module comprise moving one section of the patient support apparatus relative to another section of the patient support apparatus.

15. The patient support apparatus of claim 13, wherein the one or more functions controlled by the second user inputs of the second user module comprise adjusting the configuration of the bed frame.

16. The patient support apparatus of claim 13, wherein the one or more functions controlled by the second user inputs of the second user module comprise managing one or more alarms of the patient support apparatus.

17. The patient support apparatus of claim 13, wherein the second user inputs comprise a set of buttons.

18. The patient support apparatus of claim 1, wherein the user module is configured to substantially fill the recess.

19. The patient support apparatus of claim 1, wherein the main body of the footboard includes spaced-apart first and second side edges that face outwardly away from each other and wherein the recess is situated about midway between the first and second side edges.

20. The patient support apparatus of claim 1, wherein an upstanding support extends upwardly relative to the top edge of the main body of the footboard to hold the user module at an inclined angle relative to vertical.

* * * * *